United States Patent [19]

Krekeler

[11] 4,337,980

[45] Jul. 6, 1982

[54] WEDGE ARRANGEMENTS AND RELATED MEANS FOR MOUNTING MEANS, BASE MEMBERS, AND BITS, AND COMBINATIONS THEREOF, FOR MINING, ROAD WORKING, OR EARTH MOVING MACHINERY

[75] Inventor: Claude B. Krekeler, Cincinnati, Ohio

[73] Assignee: The Cincinnati Mine Machinery Company, Cincinnati, Ohio

[21] Appl. No.: 138,527

[22] Filed: Apr. 8, 1980

Related U.S. Application Data

[63] Continuation-in-part of Ser. No. 41,075, May 21, 1979.

[51] Int. Cl.[3] ..... E21C 35/18

[52] U.S. Cl. ..... 299/91; 37/142 R; 175/413; 175/315; 299/86; 407/46; 407/101

[58] Field of Search ..... 299/91–93, 299/86; 175/413, 315; 37/142 R, 142 A; 407/46, 101; 279/1 A, 1 E

[56] References Cited

U.S. PATENT DOCUMENTS

| | | | |
|---|---|---|---|
| 990,846 | 5/1911 | Crandall | 299/91 X |
| 990,847 | 5/1911 | Crandall | 299/91 X |
| 993,553 | 5/1911 | Rosenbeck | 407/101 X |
| 1,908,161 | 5/1933 | Meutsch | 299/91 |
| 2,612,361 | 9/1952 | Hagenbook | 299/91 X |
| 3,049,358 | 8/1962 | Polos | 279/1 A |
| 3,268,260 | 8/1966 | Snipe | 299/91 |
| 3,342,531 | 9/1967 | Krekeler | 299/92 |
| 3,429,617 | 2/1969 | Lauber | 299/93 |
| 3,498,677 | 3/1970 | Morrow | 299/92 X |
| 3,499,685 | 3/1970 | Kniff | 299/86 |
| 3,659,654 | 5/1972 | Davies et al. | 37/142 X |
| 4,299,424 | 11/1981 | LeBegue et al. | 299/93 |

FOREIGN PATENT DOCUMENTS

| | | |
|---|---|---|
| 743234 | 1/1956 | United Kingdom . |
| 1138531 | 1/1969 | United Kingdom . |

*Primary Examiner*—Ernest R. Purser
*Attorney, Agent, or Firm*—Frost & Jacobs

[57] ABSTRACT

A wedge arrangement for affixing a tool mounting means onto a base member in such manner that substantially no wear occurs between the mounting means and base member. The mounting means has a tapered portion which is wedgingly received within a correspondingly tapered cavity provided in the base member, and that part of the base member which defines the tapered cavity completely surrounds that part of the tapered portion which is seated therein. The mounting means is also provided with a perforation or socket to receive the shank or body portion of a cutting element which has a relatively sharp cutting point or edge provided thereon. This perforation, when the mounting means tapered portion is located in the base member tapered cavity in accordance with this invention, will extend not only into the mounting means but also it may extend within the confines of the base member itself; a plunger arrangement, some times fluid actuated, acting through the wedged mounting means-base member combination, may be provided for knocking out broken cutting elements. The wedge arrangement of this invention is 360° in scope and is such as to prevent relative movement between the mounting means and its base member. Supplemental elements, however, may also be employed in order to insure this.

69 Claims, 54 Drawing Figures

30
32
33
34
34a
35a
35b
36
36a
36b
36c
38
39a
40
41
42
42a
42c
43
44
45
46
4B

WEDGE ARRANGEMENTS AND RELATED MEANS FOR MOUNTING MEANS, BASE MEMBERS, AND BITS, AND COMBINATIONS THEREOF, FOR MINING, ROAD WORKING, OR EARTH MOVING MACHINERY

This is a continuation-in-part application of application Ser. No. 06/041,075 filed May 21, 1979 in the name of the same inventor and entitled MOUNTING MEANS, BASE MEMBERS AND BITS, AND COMBINATIONS THEREOF, FOR MINING, ROAD WORKING OR EARTH MOVING MACHINERY.

TECHNICAL FIELD

This invention has particular use in the mining, road planing and earth digging fields. More specifically, the invention relates to arrangements by which a tool mounting means, such as a mining machine bit holder having a socket therein to receive a bit, is located in a base member, such as used in mining machines, without any relative movement between the mounting means and base member, whereby to prevent wear of both the mounting means and base member. These arrangements are readily adapted for use in the operation of mining, road planing or earth moving equipment.

BACKGROUND ART

The present invention is especially applicable to mining machines and the like of the type having a primary drive member to which is affixed one or more base members each adapted to receive a bit holder which in turn receives a bit or cutting tool. The drive member, which in turn is driven by appropriate mechanisms, may take a number of forms such as a chain, a rotating wheel, a rotating drum or a rotating arm. The bits or cutting tools, which may also be those found in other machinery such as road working and earth moving equipment, may also take various forms such as mining machine cutter bits, road ripping elements, digger teeth and the like. All of the bits, cutting tools and the like contemplated for use in the arrangements of the present invention are characterized by having a body portion or shank provided with a cutting tip at at least one end. All of the various mounting means contemplated for use with this invention are provided with sockets or shank receiving perforations adapted to receive the body portion or shank of the bit, cutting tool and the like. Means are provided to retain the shank of the bit, cutting tool and the like in its respective mounting means during the mining, road working or earth digging operation. Means are also provided to maintain the mounting means on its respective base member which in turn is either affixed to, or made an integral part of, the drive member earlier mentioned.

Prior art workers have used many means to secure cutting tool shanks in shank receiving perforations provided in various mounting means. Set screws and other mechanical latching or locking devices have been used. A number of other arrangements, including various resilient retaining means and the like, which enabled, for example, the provision of a "knock-in", "pry-out" engagement between the cutting tool shank and the shank receiving perforation of the mounting means, have also been developed. Such a resilient retaining means is taught in U.S. Pat. No. 3,114,537. U.S. Pat. No. 2,965,365 also discloses quite satisfactory arrangements for accomplishing this. Furthermore, means for retaining a rotatable bit within a lug of a mining machine in such manner that the bit may be readily replaced are shown in U.S. Pat. No. 3,397,012. In U.S. Pat. No. 3,622,206 still other means are shown for enabling quick and easy removal of a non-rotatable cutting tool from its mounting means.

Prior art workers also recognized the importance of providing arrangements by means of which the mounting means itself could be easily and readily removed from the respective base member on which it was mounted. A number of "pin-on", "wedge-on" and other arrangements were developed for accomplishing that result. The present invention has particular application to those arrangements generally classified as "wedge-on". Athough no search of the United States prior art has been made with respect to the particular means employed for securing a mounting means to its base member, there are known United States Patents which do disclose various means of a "wedge-on" type for quickly and easily removing and replacing worn mounting means. FIG. 13 of U.S. Pat. No. 3,342,531 shows such a means in connection with a particular type of cutting tool or bit. FIG. 14 of U.S. Pat. No. 3,834,764 shows another type of wedging means. Other wedge arrangements are also disclosed in U.S. Pat. No. 4,057,294. United States application Ser. No. 936,840 filed Aug. 25, 1978 in the name of the same inventor and entitled MEANS FOR REMOVABLY AFFIXING A CUTTER BIT MOUNTING LUG TO A BASE MEMBER ON THE DRIVEN ELEMENT OF A MINING MACHINE OR THE LIKE (now U.S. Pat. No. 4,275,929 issued June 30, 1981) discloses further wedge arrangements.

The instant invention resides in an improved relationship among the mounting means, cutting tool or bit, and base member which vastly cuts down wear on both the mounting means and base member so that it is seldom necessary to remove the mounting means from the base member for replacement due to wear between the mounting means and base member.

DISCLOSURE OF THE INVENTION

This invention resides in a novel wedge arrangement for affixing a tool mounting means onto a base member in such manner that substantially no relative movement occurs between the mounting means and base member, thus vastly improving the working lives of both the mounting means and the base member. This invention is especially well suited for, and is directed to, mining, road planing or earth moving machines.

In the wedge arrangement of this invention the mounting means is provided with a tapered portion and the base member is provided with a tapered cavity to receive said tapered portion. That part of the base member which defines the cavity completely surrounds that part of the tapered portion which is seated therein, for at least a portion of the length of the tapers. The base member, mounting means and cutting element are so arranged that the resultant cutting forces encountered during operation of the equipment serve to urge the tapered portion of the mounting means into its seated position within the tapered cavity of the base member. No relative movement occurs between the mounting means and base member when the mounting means is so seated.

The wedge arrangement of this invention is 360° in scope in the sense that the base member completely surrounds the mounting means tapered portion. Contact between the tapered portion and the base member within the cavity is such that there is no rotation, wobble or other relative movement between the two when the tapered portion is properly seated in the tapered cavity. Such contact may also be 360° in scope in the sense that there may be contact between the tapered portion and base member cavity wall about the entire periphery of the tapered portion for a part, or all, of its length. Portions, at least, of those exterior sides of the mounting means which are received within the base member cavity, regardless of the cross-sectional configuration of the mounting means as taken through those sides, are tapered, and the interior walls defining the base member cavity are correspondingly tapered.

The base member may be a part which is permanently secured to the basic mining, road planing or earth digging machine, or it may in fact be the machine itself, or some integral part thereof. As indicated, the base member is provided with a tapered cavity to just nicely receive the mounting means with a wedging action.

Various means may also be provided to reinforce the wedged relationship between the mounting means and base member and to further insure that the mounting means tapered portion does not rotate within the tapered cavity provided for it in the base member.

The mounting means is provided with a perforation or socket to receive the shank or body portion of the cutting tool or bit, road ripping element, digger tooth or the like. These cutting elements are provided with relatively sharp cutting points or edges and with shanks that are received within the mounting means perforation or socket. These mounting means may also be referred to variously as lugs, bit holders, blocks, socket members and the like.

It is a feature of this invention that the relationship among the base member and its cavity, the mounting means and its perforation, and the cutting elements and their shanks or body portions, is such that when the cutting element is properly seated within its respective shank receiving perforation provided in the mounting means, and when the mounting means is properly located in the tapered cavity provided for it is the base member, the body portion or shank of the cutting element will extend not only into its respective perforation but also it may extend, while still being seated within such perforation, within the confines of the base member cavity; in all instances the cutting tool body portion or shank will at least be brought closer to, if not within, the base member, thus making for an overall arrangement which is: (a) easy and less expensive to manufacture; (b) capable of being used in restricted areas; (c) stronger; and (d) capable of utilizing means which permit easy replacement of the cutting element.

Bits, cutting elements and the like do on occasion break. Broken bits do present special bit removal problems which are also solved by this invention. This invention, therefore, contemplates special bit knock-out means which may comprise plungers which may be actuated by blows, levers, fluid pressure, screws or other means. The screw means may even replace the plunger. Further means are also provided in addition to the basic wedge concept embraced by this invention, to give even greater protection against any possible wear, including means for repositioning various parts of the wedged combination from time to time.

BRIEF DESCRIPTION OF THE DRAWINGS

FIG. 5 is a fragmentary side elevational view depicting another mounting means adapted for use in this invention.

FIG. 15B is another view depicting a still different arrangement for retaining the mounting means within the base member cavity.

FIG. 25 is a sectioned side elevational view of a modification of the base member and mounting means arrangement of FIG. 24.

FIG. 26 is a sectioned side elevational view of the base member and mounting means arrangement of FIG. 25 but showing the base member as modified to receive a different type of bit.

FIG. 36 is a sectioned view of a mounting means adapted to be received within various of the base members depicted and modified so as to include a plunger element for expelling broken bits.

FIG. 37 is a sectioned view of a mounting means like that shown in FIG. 36 with a somewhat different arrangement for actuating the bit expelling means.

FIG. 38 is a sectioned side view of a mounting means provided with a fluid actuated plunger for expelling a broken bit.

FIG. 39 is a view similar to that of FIG. 38 and including a depiction of the broken bit being expelled and the coupling for applying fluid pressure to the plunger there depicted.

DETAILED DESCRIPTION OF THE INVENTION

Figure 1:
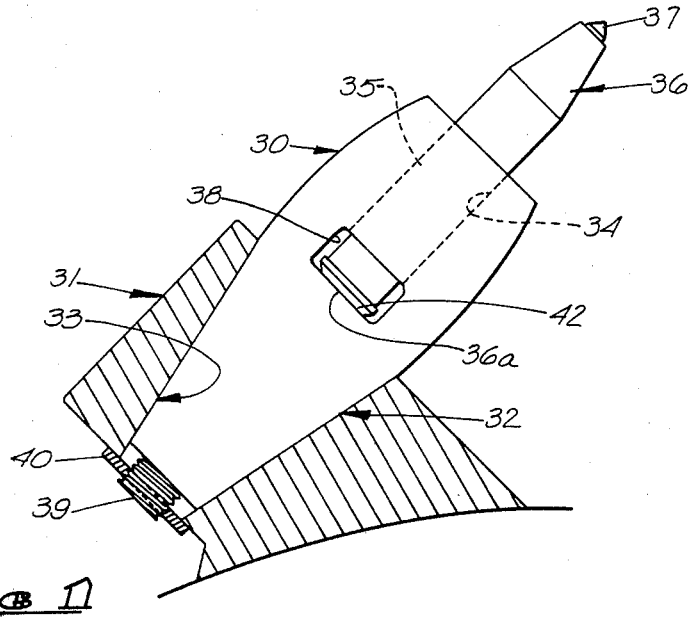
FIG. 1 is a fragmentary side elevational view, partly in cross section, illustrating a base member, mounting means and cutting element, all as arranged in accordance with the teachings of this invention.

Referring first to FIGS. 1, 16A, 16B and 16C the invention is broadly illustrated as residing in a novel wedge arrangement for affixing a tool mounting means generally indicated at 30 onto a base member generally indicated at 31 in such manner that substantially no relative movement occurs between the mounting means 30 and base member 31, thus vastly improving the working lives of both the mounting means and the base member. The mounting means is provided with a tapered portion generally indicated at 32 and the base member 31 is provided with a tapered cavity 33 to just nicely receive the mounting means tapered portion 32. As somewhat diagramatically illustrated in FIGS. 16A, 16B and 16C the tapered mounting means sections can be of any shape such as, by way of example only, the circular, rectangular and scalloped shapes indicated in these FIGURES at 32*a*, 32*b* and 32*c*. It will be understood by those skilled in the art, however, that the sections are not to be limited only to those depicted in these Figures and others; rather, the sections can be of any shape so long as the base member cavity 33 is so shaped as to just nicely recieve the various mounting means tapered portions 32 therewithin.

The wedge arrangement of this invention is substantially 360° in scope in that the base member completely surrounds, for at least a portion of the length of the taper imparted to the mounting means, that part of the tapered portion which is seated within the tapered cavity, so that all relative movement between the mounting means 30 and base member 31 is prevented. Portions at least of those exterior sides of the mounting means tapered portion 32 which are received within the correspondingly tapered base member cavity 33, regardless of the cross-sectional configuration of the mounting means portion 32, are tapered; as noted, interior walls defining the base member cavity 33 are correspondingly tapered.

This invention will be largely described in connection with mining machinery having bit holders and base members joined by the wedge arrangement of this invention and utilizing either rotatable or non-rotatable bits; various arrangements for retaining the tapered portion 32 of the mounting means within the corresponding tapered cavity 33 of the base member are shown. It will be understood by those skilled in the art that many of these retaining means are interchangeable and do not have to be limited to the particular mounting means-base member combination with which it is illustrated. Like numerals will be used to designate like parts throughout the description.

Although, as indicated, the detailed description of the invention is in connection with mining equipment, it should be plainly evident to those skilled in the art from what has been said before and from the description to follow, with reference to the drawings and claims, that the wedge arrangement of this invention also has application in other fields, particularly the road planing and earth digging arts.

The base member 31 may be a part which is permanently secured to the basic mining, road planing or earth digging machine, or it may in fact be the machine itself (see, for example, FIG. 21 wherein the base member 31*a* is depicted as a drum provided with a tapered cavity 33*a* to receive a mounting means or bit holder 30 of any style), or some integral part thereof. As indicated, it is required in all of these arrangements that the base member 31 be provided with a tapered cavity 33 to just nicely receive the tapered portion 32 of the mounting means 30 with a wedging action.

Referring again to FIG. 1, it will be observed that in this instance the mounting means 30 is provided with a preforation or socket 34 to receive the shank or body portion 35 of the cutting tool or bit 36, it again being pointed out that this tool or bit 36 could be, by way of examples, a road ripping element, a digger tooth, or the like. These cutting elements, whatever they may specifically be, are usually provided with relatively sharp cutting points or edges and with shanks 35 that are received within the mounting means perforation 34; the bit 36 of FIG. 1 is rotatable and is provided with a hardened cutting point 37. It should also be noted that these mounting means 30 may be referred to variously as lugs, bit holders, blocks, socket members and the like.

It is a feature of this invention that the relationship among the base member 31 and its tapered cavity 33, the mounting means 30 and its tapered portion 32 and its bit receiving perforation 34, and the cutting element or bit 36 and its shank or body portion 35, is such that when the cutting element 36 is properly seated within the shank receiving perforation 34 provided in the mounting means 30, and when the tapered portion 32 of the mounting means 30 is properly located within the tapered cavity 33 provided for it in the base member 31, the lowermost end 36*a* of the cutting element 36 will, while properly located within the perforation 34, extend either quite close to, or actually within, the confines of the base member cavity 33. In FIG. 1 the cutting element end 36*a* is depicted as stopping just short of such confines while in FIG. 2 the cutting element end 36*a* is shown as extending well within such confines.

The mounting means 30 of FIG. 1 is shown as being provided with a bleed hole 38 which is also large enough to receive some kind of retainer (not shown) by which the cutting element or bit 36 is prevented from being accidentally dislodged from the mounting means. This bleed hole 38 will permit discharge of noxious fines and the like which may accumulate in the shank receiving perforation 34.

The mounting means 30 of FIG. 1 is illustrated as being provided with a threaded stem 39 to receive a nut 40 by means of which the mounting means 30 is retained in the base member 31, particularly during those times when the cutting element 36 is not engaged with material being acted upon. As will become apparent as this description proceeds, there are many satisfactory means for retaining the mounting means 30 within the base member 31 and a number of these will be illustrated. The invention is not to be limited to such retaining means, however, unless they are specifically made a part of the claims which follow.

Figure 2:
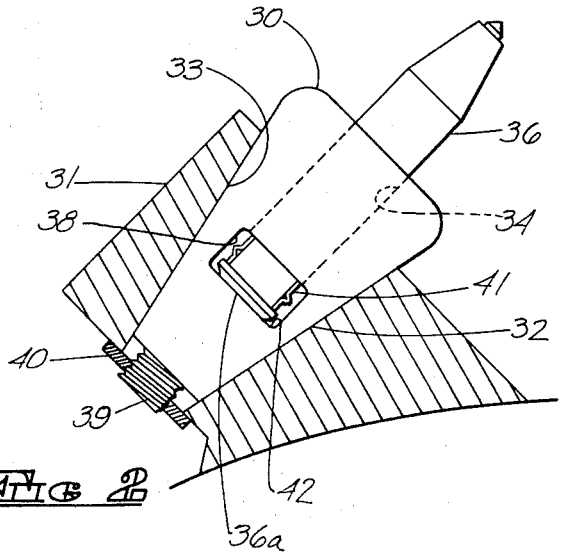
FIG. 2 is a view similar to that of FIG. 1 but illustrating a modification of the relationship among the base member and its cavity, the mounting means and its perforation, and the cutting element.

The wedge arrangement of FIG. 2 is generally like that of FIG. 1. In this arrangement the lower end 36*a* of the cutting element 36 is within the confines of the tapered cavity 33. The bleed hole 38 is also so located. It is preferred, therefore, to provide the base member 31 with a corresponding bleed hole for escape of the noxious fines mentioned above; the bleed hole may be considered as passing through both the base member 31 and mounting means 30. A captive keeper, for example, one such as illustrated in U.S. Pat. No. 3,767,266, is shown at 41 for retaining the cutting element 36 within the shank receiving perforation 34 of the mounting means 30.

In FIGS. 1 and 2 the invention has been illustrated in modifications wherein the combination includes a rotatable cutting element 36. There are other types of rotatable cutting elements which may be employed and there are also non-rotatable cutting elements which may be employed. Some of these will be described. It is again to be understood by those skilled in the art, however, that this invention is susceptible for use with many different kinds of cutting elements and the invention is not to be limited to particular cutting elements except insofar as they may be specifically set forth in the subjoined claims. In this connection it should be noted that, by way of example, the bits 36 engage the abutment surface 42 of the bit holder 30 as defined by the bottom of the perforation 34.

Figures 3, 4A, 4B, 4D:
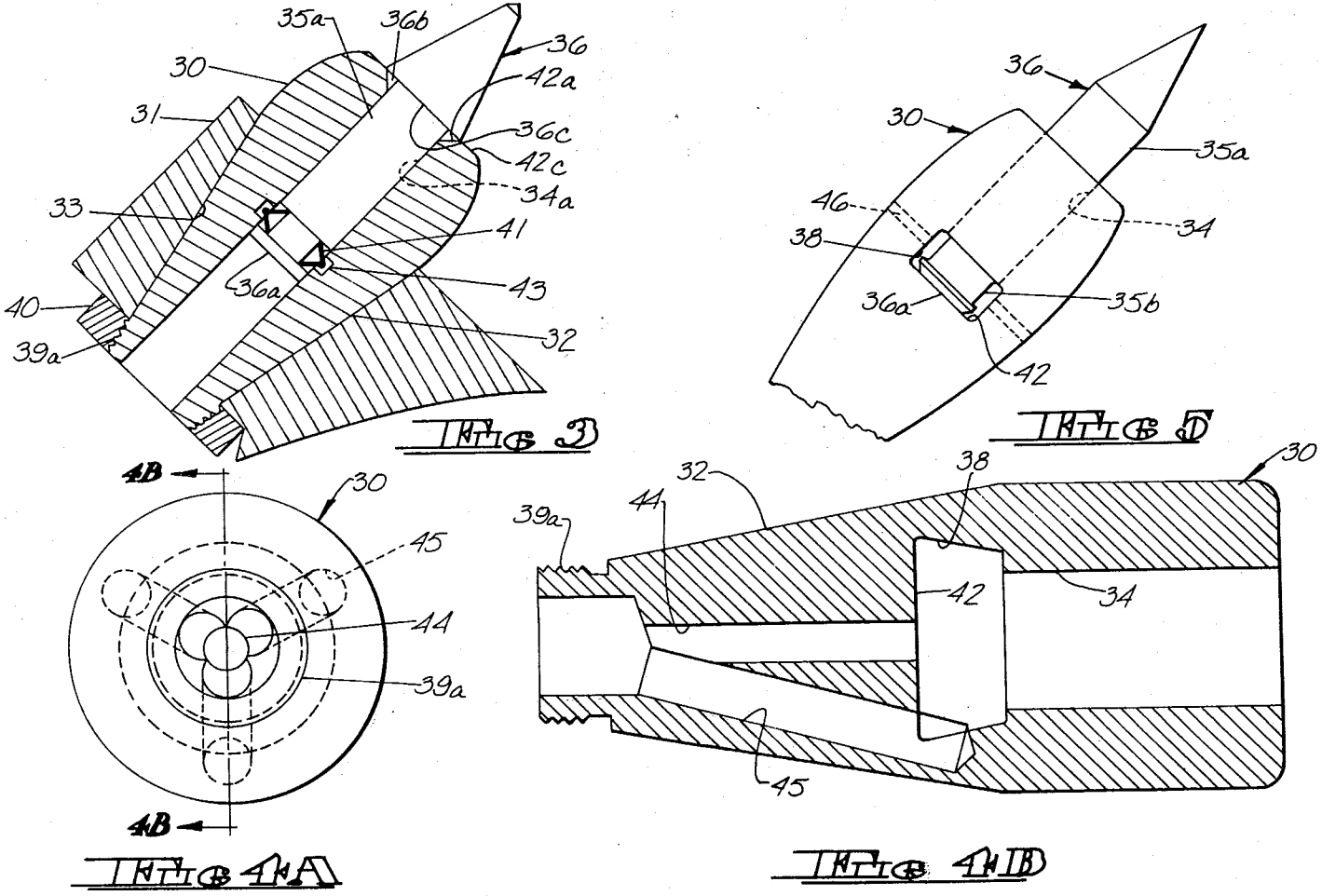
FIG. 3 is a sectioned side elevational view of another modification of the base member and mounting means arrangement.
FIG. 4A is an end view of the mounting means depicted in FIG. 4B.
FIG. 4B is a sectional view taken on the line 4B—4B of FIG. 4A.

In the mounting means, base member, bit combination of FIG. 3 the perforation 34*a* is shown as extending clear through the bit holder 30; this permits dirt and noxious mine fines to bleed out. This, however, does away with the abutment surface 42 earlier described; such gauge abutment surface, therefore, has been relocated, this time taking the form of a countersunk, conical shoulder 42*a* provided at the foward end of the bit holder 30. The bit 36, which is of the "plumb-bob" type, has a correspondingly tapered, conical shoulder 36*b* which engages the abutment surface 42*a*. It will be understood by those skilled in the art that the abutment surface 42*a* and bit portion 36*b* could be eliminated, and the gauge abutment means would constitute a shoulder 36*c* which would engage the forward surface 42*c* of the bit holder. In the FIG. 3 arrangement that part of the bit holder which extends through and beyond the base member cavity 33 is threaded as indicated at 39*a* to receive the retaining nut 40. The bit 36 is retained within the bit holder 30 by means of a captive keeper 41 which engages within an annular groove or the like 43 provided in the bit holder 30.

A somewhat modified mounting means or bit lug 30 is illustrated in FIGS. 4A and 4B. This particular bit lug is to utilize a rotatable bit with a captive resilient retainer similar to those shown, for example, in U.S. Pat. No. 3,767,266. This is necessary because, when the bit lug is properly seated within the base member cavity, the bit lug and enlarged annular area 38 will be entirely enclosed by the base member in the vicinity of the retainer thus making it impossible to utilize a radial installed retainer. A knock-out hole is located in the central portion of the abutment surface or anvil 42 and this hole extends through the threaded end 39*a*. In addition to the knock-out hole 44, three bleed holes 45, spaced approximately 120° apart and converging toward the rear or threaded end 39*a* of the bit lug 30, are provided so as to bleed off any accumulation of dirt that might otherwise clog the hole and prevent the bit from rotating as desired; this number is not critical.

Figure 6A:
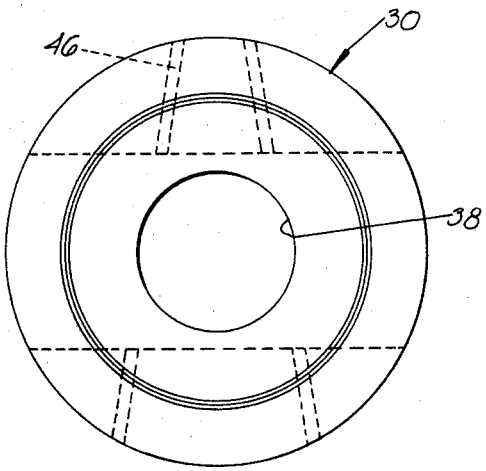
FIG. 6A is a view illustrating one manner in which a cutting element may be retained in a mounting means used in this invention.
Figure 6B:
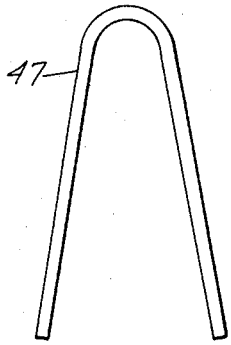
FIG. 6B is a perspective view of a retainer adapted for use with the arrangement of FIG. 6A.
Figure 7A:
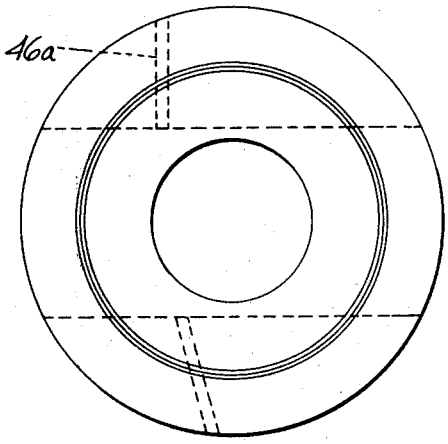
FIG. 7A is a view illustrating another manner in which a cutting tool may be retained in a mounting means adapted for use in this invention.
Figure 7B:
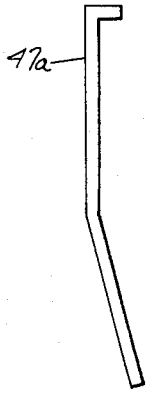
FIG. 7B is a perspective view of a retainer adapted for use in the arrangement of FIG. 7A.

The mounting means 30 of FIG. 5 is generally like that illustrated in FIG. 2 wherein a rotatable cutting element or bit 36 having an abutment surface 36*a* is received within the shank receiving perforation 34 with the surface 36*a* abutting the gauge abutment surface 42. The shank 35*a* is provided with an annular notch 35*b*. Instead of locating a captive keeper 41 in the notch 35*b*, however, the arrangements of either FIGS. 6A and 6B, or FIGS. 7A and 7B, are used to retain the bit 36 within the perforation 34. In the arrangement of FIGS. 6A and 6B a pair of holes 46, roughly defining a portion of a "V", are located in the mounting means 30 so as to intersect the opening 38. A resilient retainer 47 having a relaxed position which is roughly "V-shaped" is inserted through the pair of holes 46. The retainer 47, when fully inserted, will extend within the annular groove 35*b* provided in a cutting element 36 thereby to retain such element within the perforation 34. The arrangement of FIGS. 7A and 7B is quite similar but utilizes only a single hole 46*a* and a one-legged resilient retainer 47*a*, it again being noted that the retainer 47*a* will intersect the opening 38 and pass through the notch 35*b* of a bit 36 when seated within the mounting means 30. It should be clear to those skilled in the art that either of the retaining means arrangements of FIGS. 6A, 6B and 7A, 7B could be utilized in place of the captive keeper 40 of FIG. 3 so as to retain a shouldered bit within its mounting means.

Figure 8A:
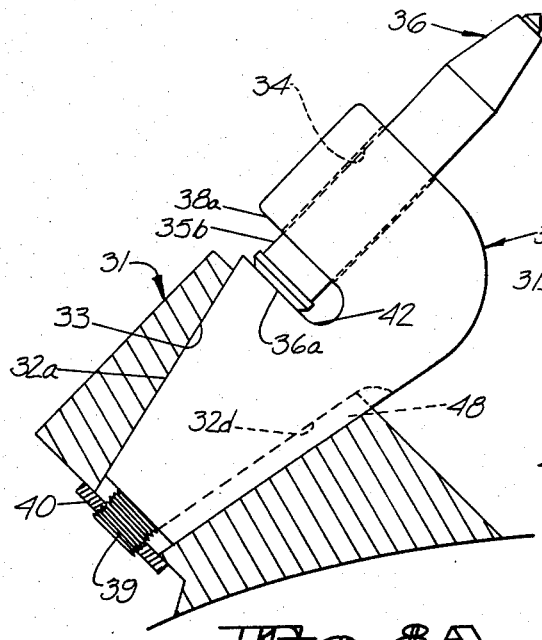
FIG. 8A is a fragmentary elevational view, partly in section, of a modified base member, mounting means and cutting element combination in accordance with this invention.
Figure 8B:
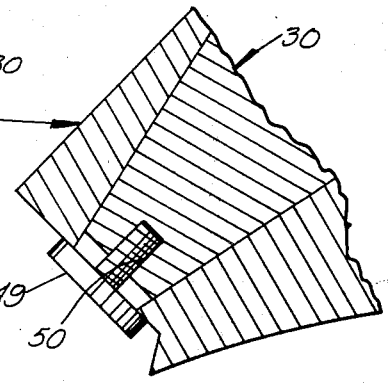
FIG. 8B is a fragmentary sectional view illustrating one way in which the mounting means may be retained in the base member cavity.

A somewhat different style of mounting means 30 is depicted in FIGS. 8A and 8B. Such mounting means, however, also have a tapered portion 32 which seats within the correspondingly tapered cavity 33 of the base member 31. In those instances, like that illustrated in FIG. 8A, wherein the tapered portion 32 of the mounting means 30 is circular in cross section, it is desirable to employ positive means to prevent relative, rotational movement between the mounting means portion 32*a* and the base member 31. In FIG. 8A such positive means are represented by the key 48 which extends from the wall of the base member cavity 33 into a slot 32*d* located in the tapered mounting means portion 32*a* which, as stated, in this instance is circular in cross section in the manner also indicated in FIG. 16A. Although not shown it will be understood by those skilled in the art that the rotatable bit 36 may be retained within the perforation 34 by means of a C-shaped clip or the like inserted via the open, notched portion 38*a* to engage the exposed shank portion 35*b*.

It is also to be understood that while the key 48 of FIG. 8A has been illustrated as being on the base member 31 and the key slot 32*d* within the mounting means 32*a*, the reverse of this is perfectly feasable; an alternative arrangement would be to provide matching key slots in both the mounting means and base member with a third member driven into said matching key slots and having a press-fit therein.

Figure 8C:
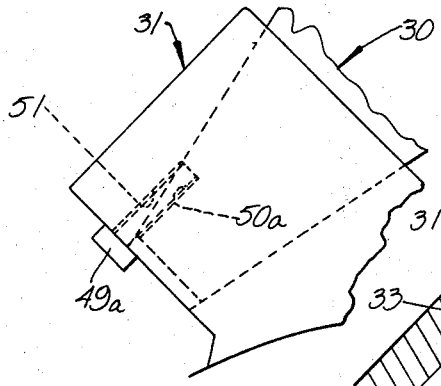
FIG. 8C is another fragmentary view illustrating a different arrangement for retaining the mounting means within the base member cavity.

FIGS. 8B and 8C illustrate alternative ways of retaining the mounting means 30 within the base member 31. In FIG. 8B the threaded portion 39 and nut 40 of FIG. 8A have been replaced by the headed, threaded member 49 having a stem threadedly engaged within the threaded hole 50. A variation of this arrangement is depicted in FIG. 8C wherein a screw 49*a* passes through a clearance opening 51 provided in the base member 31 so as to engage the threaded hole 50*a* provided in the mounting means 30.

Figure 9:
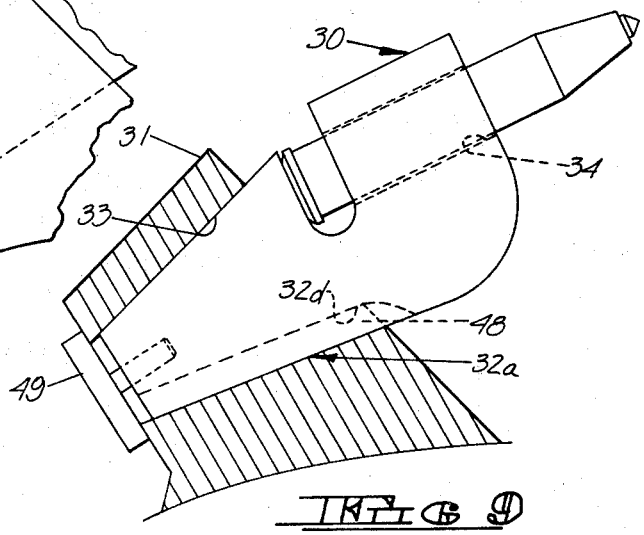
FIG. 9 is a fragmentary side elevational view, partly in section, showing another manner in which a base member, mounting means and cutting element may be arranged in accordance with the teaching of this invention.
Figure 15:
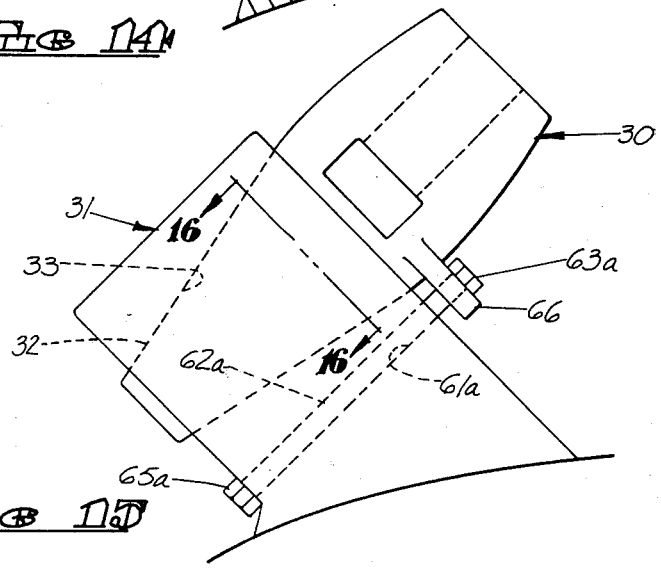
FIG. 15 is a fragmentary side elevational view of the combination of this invention as depicted with still other means for retaining the mounting means within the base member cavity.
Figure 16A:
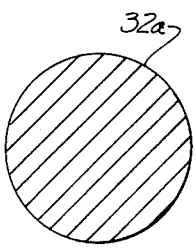
FIGS. 16A, 16B and 16C are cross sectional views diagrammatically illustrating the fact that the tapered portion of that part of the mounting means which is received in the correspondingly tapered cavity of the base member may take any shape desired, including, but without limitation, circular, rectangular and irregular.
Figure 16B:
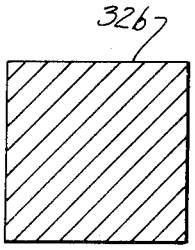
Figure 16C:
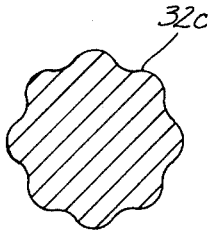

The arrangement of FIG. 9 is generally like that depicted in FIG. 8A differing primarily in that the axis of the bit receiving perforation 34 is out of alignment with the axis of the base member cavity 33. Again, if the cross section through the tapered portion 32 of the mounting means 30 is circular as depicted in FIG. 16A, means such as the key-slot arrangement 48, 32*d* will be provided to prevent turning of the mounting means 30 within the base member 31. In this connection it should be understood by those skilled in the art that when such cross section is non-circular in the manner generally depicted at 32*b* and 32*c* in FIGS. 16B and 16C, means such as those indicated at 32*d*, 48 will not have to be employed. (The arrangement of FIGS. 8C, 15A and 15B also prevent rotation).

Figure 10A:
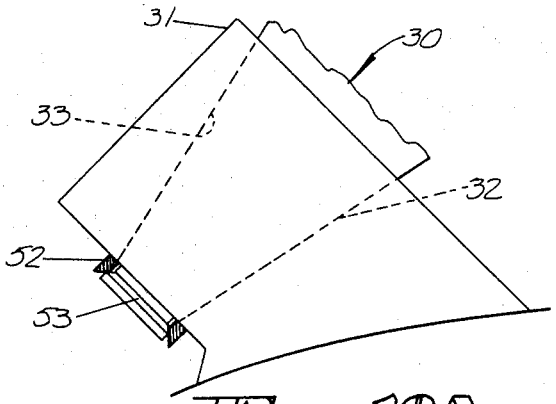
FIG. 10A is a fragmentary side elevational view, partly in section, illustrating a means for retaining a mounting means within a base member in accordance with the teaching of this invention.
Figure 10B:
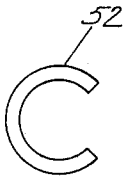
FIG. 10B is a perspective view of the retaining means employed with the arrangement illustrated in FIG. 10A.
Figure 12A:
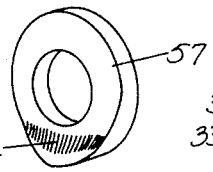
FIG. 12A is a perspective view of a portion of the retaining means used in the arrangement of FIG. 12.

As has already been indicated, various means may be employed to retain the tapered portion 32 of the mounting means 30 within the correspondingly tapered cavity 33 of the base member 31. In the arrangement of FIGS. 10A and 10B such means comprises A C-shaped retaining member 52, wedge-shaped in cross section, forced into an annular notch 53 provided in the lower end of the tapered portion 32.

Figure 11:
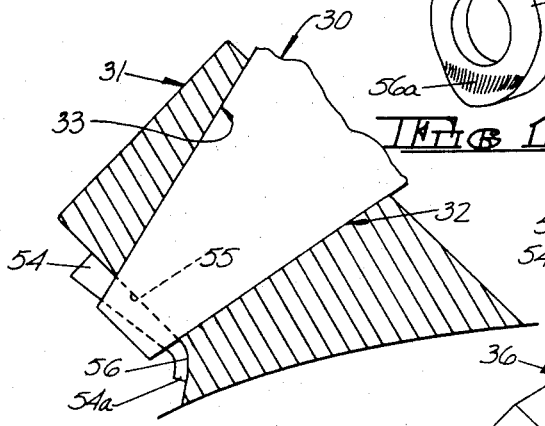
FIG. 11 is a fragmentary side elevational view, partly in section, illustrating another means by which the mounting means may be retained in the base member cavity in accordance with the teachings of this invention.
Figure 12:
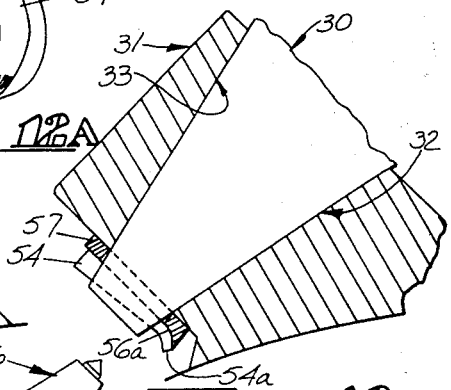
FIG. 12 is a fragmentary side elevational view, partly in section, depicting a modification of the retaining arrangement of FIG. 11.

Other retaining means are illustrated in FIGS. 11 and 12. In FIG. 11 a peg or wedge 54 is driven through a tapered hole 55 provided in the lower end of the tapered portion 32 of the mounting means 30 so as to engage the cam surface 56 provided on the base member 31 thereby to produce a deformation 54*a* which prevents the wedge 54 from coming loose. A variation of this arrangement is depicted in FIG. 12 wherein the cam surface 56*a* is provided on a washer 57 engaged about the tapered portion 32 beneath the base member 31.

Figure 13A:
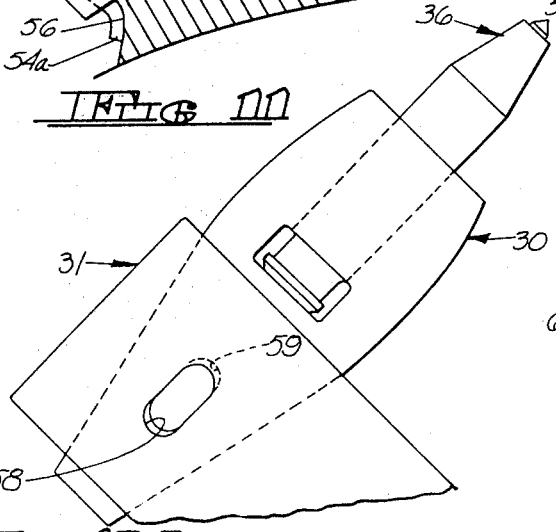
FIG. 13A is a fragmentary, side elevational view of a base member, mounting means, bit combination in accordance with this invention and utilizing certain means for retaining the mounting means in the base member cavity.
Figure 13D:
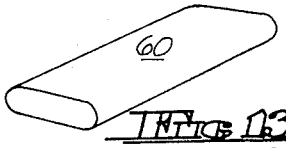
FIG. 13B is a perspective view of a retainer adapted for use in the combination depicted in FIG. 13A.
FIG. 13C is a perspective view illustrating a modified retainer also adapted for use in the combination depicted in FIG. 13A.
Figure 13C:
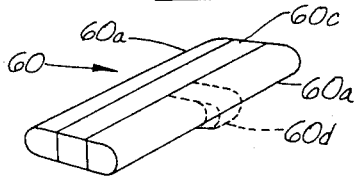

Still other retaining means are disclosed in FIGS. 13A, 13B and 13C. The mounting means, base member, bit combination may be generally like that illustrated at, for example, in FIG. 1.

In this arrangement a pair of retainer receiving perforations 58 and 59, slightly off set with respect to one another, are provided in the bit holder 31 and mounting means 30, respectively. When a retainer 60, such as indicated in FIG. 13B, made of semi-rigid, deformable material is forced through the perforations 58 and 59 it will be compressed so as to frictionally engage within such perforations whereby it won't be accidentally dislodged, therefrom, thus keeping the mounting means 30 within the base member 31. A modification of the retainer 60 is indicated in FIG. 13C wherein the retainer is laminated, having two rigid sections 60*a* located on either side of a resilient section 60C. Either of the retainers of FIGS. 13B and 13C could be provided with a nose diagramatically indicated at 60*d* which could engage within the slot 59 to further prevent accidental dislodgement of the retainer.

Figure 14A:
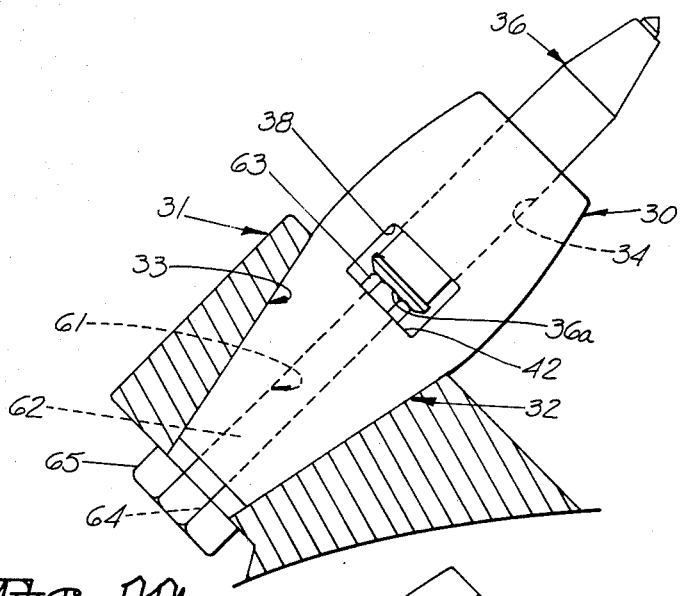
FIG. 14 is a fragmentary side elevational view, partly in cross section, illustrating the base member, mounting means, cutting element combination of this invention as used with modified means for retaining the mounting means within the base member cavity.
Figure 15A:
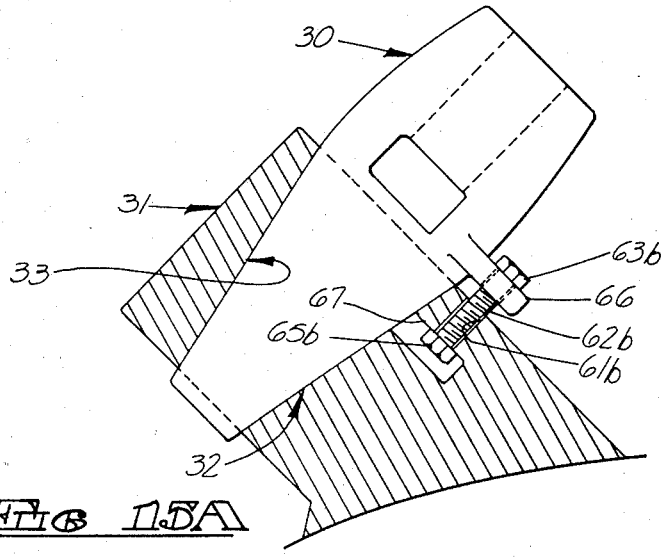
FIG. 15A is a different view of the basic arrangement of FIG. 15 but showing further modified means fore retaining the mounting within the base member cavity.
Figure 19B:
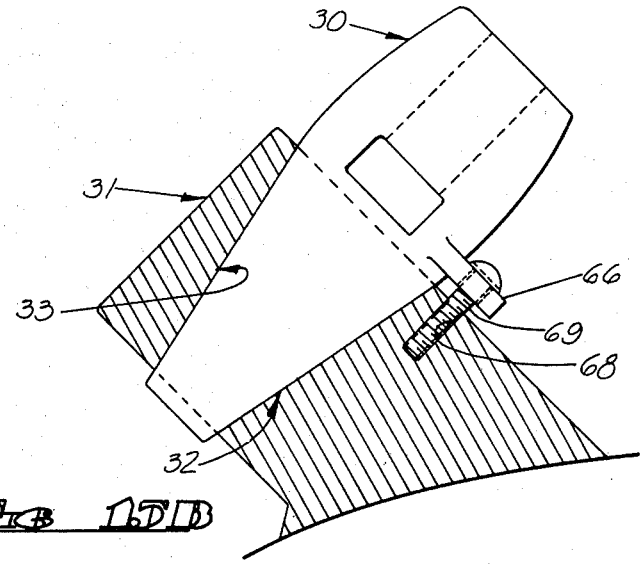
FIG. 19 is an elevational view, partly in section, illustrating the base member as being fixed to a drum and the like, the mounting means again having a tapered portion received in a tapered cavity provided in the base member, with means to retain the mounting means in the base member cavity, and showing a non rotatable bit as a part of the combination.

In FIG. 14 one manner of bolting the mounting means 30 to the base member 31 is illustrated. The mounting means, base member, bit combination used for purposes of this illustration is generally like that of FIG. 1. In the arrangement of FIG. 14, however, a hole 61 extends through the tapered portion 32 of the mounting means 30 and a bolt 62 having a head 63 and threaded end 64 passed therethrough. The underneath side of the bolt head 63 engages the the gauge abutment surface 42 and the top side of this head, therefore, is that which is actually engaged by the abutment surface 36*a* of the bit 36. A nut 65 is screwed onto the threaded end 64 of the bolt 62 whereby to secure the mounting means in place on the base member 31. FIGS. 15, 15A and 15B show modifications of the bolt arrangement generally depicted in FIG. 14. In FIG. 15 the hole 61*a* is located outside of the cavity 33 and the mounting means 30 is provided with an extension 66. The head 63*a* of the bolt 62*a* engages the shelf 66 and the nut 65*a* is threaded onto the end of the bolt whereby to hold the members 30 and 31 together. In FIG. 15A the means are depicted as comprising a short bolt 62B having its threaded end terminating within a clearance opening 67 sufficiently large enough to permit one to engage a nut 65*b* on the bolt 62*b*. In the FIG. 15B arrangement the clearance opening 67, or clearance hole 61, 61*a*, is replaced by a tapped hole 68 into which the headed screw 69 may be secured.

Figure 17:
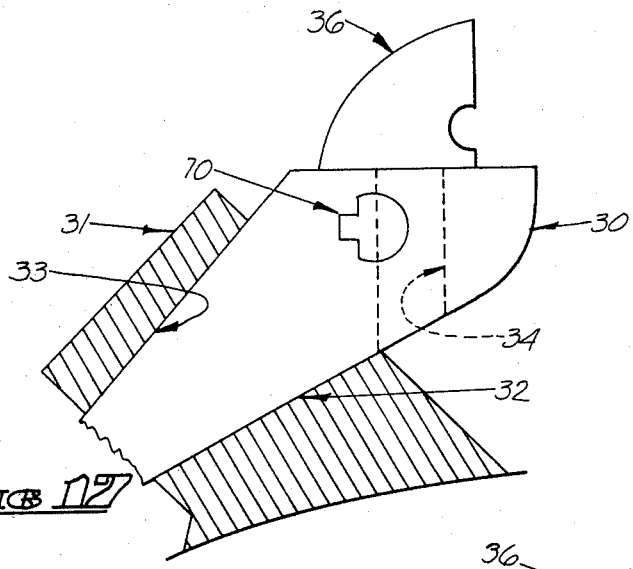
FIG. 17 is a fragmentary side elevational view, partly in section, illustrating an embodiment of this invention wherein a non rotatable bit is utilized in the combination.

FIG. 17 is a somehwat schematic illustration of the fact that bits other than the various rotating bits so far described may be utilized in mounting means, base member combinations embodying this invention. As pointed out in connection with FIG. 9, it is not necessary that the axis of the bit receiving perforation 34 of the mounting means 30 and of the base member cavity 33 be in alignment. The non-rotatable bit 36 and keeper means 70 of the FIG. 17 arrangement are like those disclosed in U.S. Pat. No. 2,965,365. As indicated, and as will be understood by those skilled in the art, many other styles of bits may be used in the practice of this invention. It is pointed out, as should be apparent to those skilled in the art, that any of the additional retaining means shown and described in connection with the other figures comprising a part of this application may be utilized to retain the tapered portion 32 of the mounting means 30 within the cavity 33 of the base member 31. It is also true of all of these arrangements, however, that the wedge action achieved by this invention, standing alone, may be sufficient to prevent relative movement between the mounting means and base member. In all instances the arrangement will be such as to prevent relative, rotational movement between the mounting means and base member while at the same time retaining the tapered portion 32 in full 360° contact with the base member 31 within the cavity 33.

Figure 18:
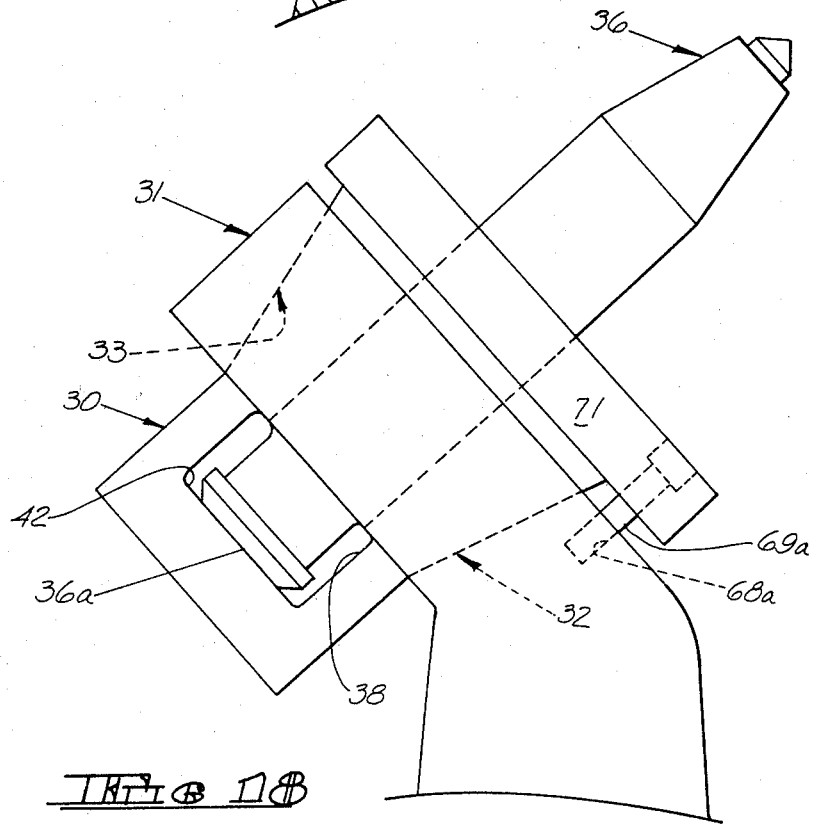
FIG. 18 is a fragmentary side elevational view illustrating another arrangement by which a different sort of tapered mounting means may be retained on a somewhat different base member having, however, the necessary tapered cavity.

The retaining arrangement for the mounting means 30 and base member 31 of FIG. 18 is somewhat like that depicted in FIG. 15B in that a tapped hole 68*a* is engaged by a screw 69*a* seated within a collar 71 (which replaces the shelf 66, for example, of FIG. 15) provided on the mounting means 30.

Figure 19:
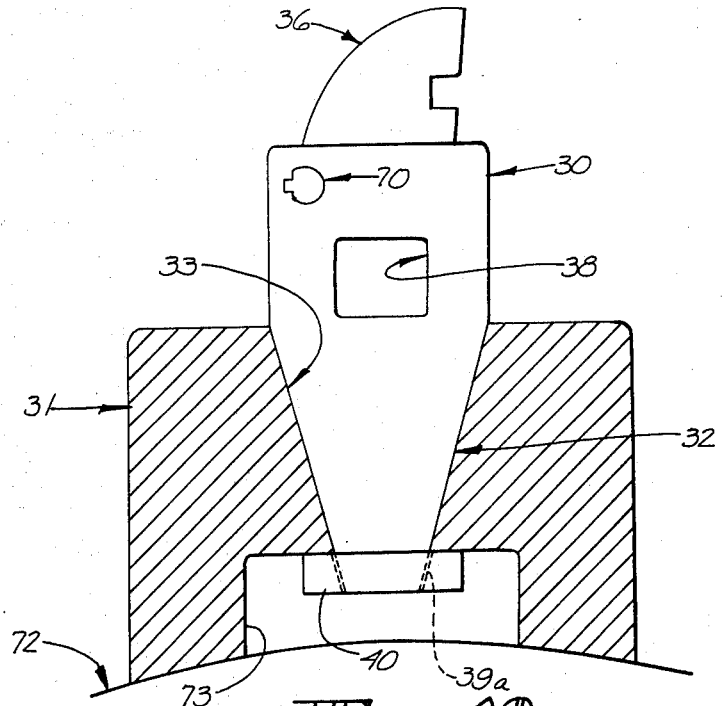
Figure 20:
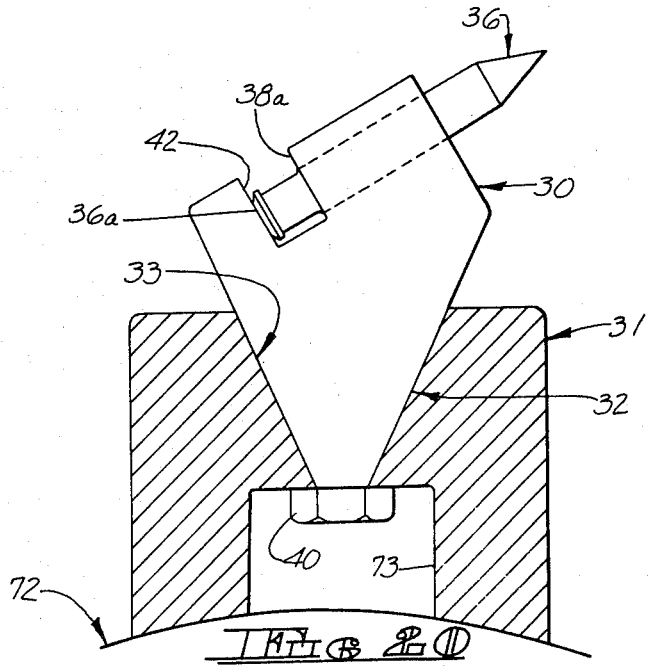
FIG. 20 is a fragmentary elevational view, partly in section, depicting a base member as attached to a drum and the like, again illustrating a mounting means having a tapered portion received in a correspondingly tapered cavity provided in the base member, the mounting means being shown as accepting a rotatable bit as part of the combination.

FIGS. 19 and 20 are further illustrations of the fact that the mounting means, base member, bit combinations of this invention may be employed with either non-rotatable bits or rotatable bits. In these Figures the retaining means for securing the tapered portion 32 of the mounting means 30 within the tapered cavity 33 of the base member 31 are those indicated at 39*a*, 40 in FIG. 3 and 39, 40 in FIG. 2. In these arrangements of FIGS. 19 and 20, however, the base member 31 is depicted as being secured to the outer surface of a drum or the like 72 and, therefore, it is necessary to provide the base member with an access opening 73 for proper securing of the nut 40.

Figure 21:
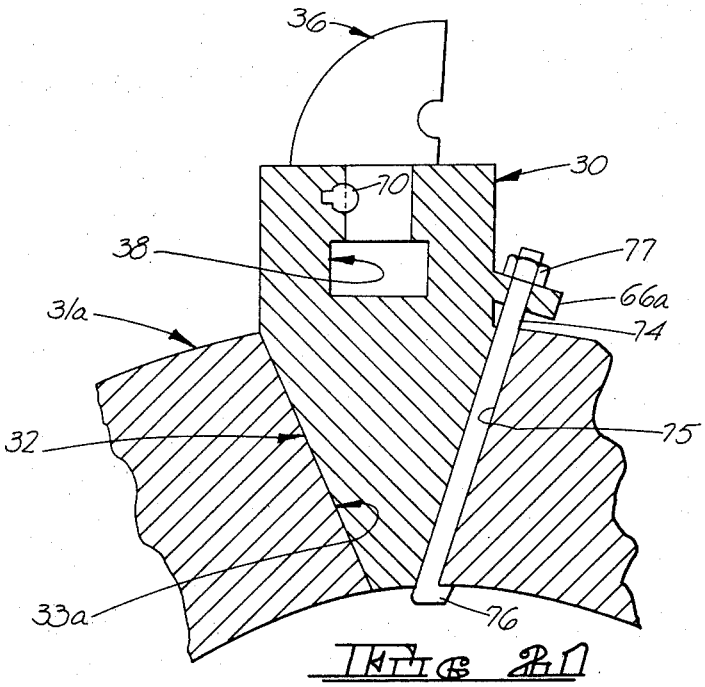
FIG. 21 is illustrative of that facet of the invention wherein the base member may be an integral part of the mining, road planing or earth digging equipment, in this case the base member tapered cavity being provided directly in the drum, retaining means for securing the mounting means within the cavity being illustrated, the mounting means in this instance receiving a non rotatable bit as a part of the combination.

FIG. 21 illustrates a modification of this invention earlier mentioned wherein the base member is the basic mining, road planing or earth digging machine itself, as distinguished from other arrangements wherein the base member is a separate part which is permanently fastened to such a machine. In FIG. 21 the base member generally indicated at 31*a* may be a mining machine drum, or other drive member (in turn driven by separate mechanisms) associated with mining, road planing or earth digging machinery, and the tapered cavity 33*a* is located directly in such member 31*a*. Although FIG. 21 shows the invention as applied to a mounting means carrying a non-rotatable cutting element, it will be understood by those skilled in the art that any of the cutting elements, non-rotatable or rotatable, depicted in the other Figures may be employed. In this arrangement of FIG. 21 the mounting means 30 is secured within the tapered cavity 33*a* of the machine (base member) 31*a* by means of an elongated member 74 which passes through a clearance hole 75 provided in the member 31*a* so that it extends through the shelf 66*a*. The member 74 has a hook portion 76 which engages the member 31*a* while a nut 77 is screwed onto that end of the member 74 which projects beyond the shelf 66*a*. As indicated the mounting means 30 may be of any style and may accommodate any kind of bit, and various of the means for securing the mounting means within the base member 31*a* may be employed. And while the machine generally indicated at 31*a* in this FIG. 21 has been described as a mining machine drum with tapered holes 33*a*, those skilled in the art will understand that this machine may be another mining machine or machines such as are used in the road planing and earth digging arts.

Figure 22:
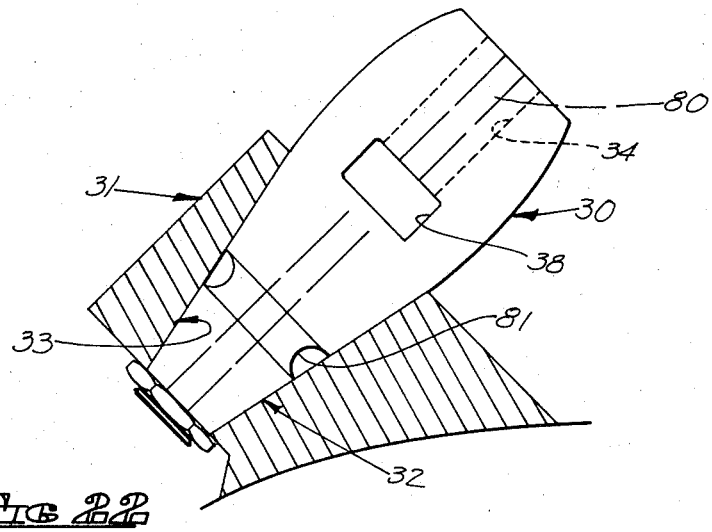
FIG. 22 is a rather semi-schematic depiction of the fact that the objectives of this invention may be achieved whether or not the taper imparted to that part of mounting means which is seated within the correspondingly tapered cavity of the base member is continuous, either longitudinally or circumferentially.

FIG. 22 illustrates the fact that while the wedge arrangement of this invention is 360° in scope in the sense that that part of the mounting means tapered portion 32 which is received within the correspondingly tapered cavity 33 of the base member is thereby completely surrounded by the base member, the taper for such part does not have to extend completely around, or completely through the length of, such part. This figure shows that the tapered portion 32 may be interrupted by one or more flats or grooves 80, for example, extending through the length of the tapered portion, or by an annular flat, groove or other interruption 81, extending completely around the tapered portion. Such flats, grooves or other interruptions, however, whether considered as around the periphery of, or along the length of, the mounting means tapered portion, need not extend completely around, or completely along, such portion. In any event that part of the tapered portion 32 which is received within the tapered cavity 33 is completely surrounded by the base member, and contact between that part and the base member within the cavity is such as to prevent any rotation, nutation, wobble or other relative movement between such part and the base member.

Several means have been shown and described for retaining the tapered portion of the mounting means within the tapered cavity of the base member. Such means, in addition to preventing accidental dislodgement, for example, of the mounting means from the base member, may also serve to urge the tapered portion to its seated position within such cavity, thus further insuring that there will be no relative movement between the mounting means and base member.

Furthermore, while in some instances separate means have been shown and described for the purpose of preventing rotation of the mounting means tapered portion within the tapered cavity of the base member, as for example when the cross sections of such portion and cavity are circular, such separate means may not be required; it may be that the 360° welding action (as defined herein) standing alone, will suffice. This action may also be sufficient to retain the tapered portion within the tapered cavity.

From the foregoing it should be plainly evident that this invention, which is directed to the mining, road planing and earth digging arts, resides in a novel wedge arrangement by which a mounting means carrying a cutting element is affixed to a base member in such manner that substantially no relative movement occurs between the mounting means and base member. The wedge arrangement of this invention is 360° in scope. Those exterior sides of the mounting means which are received within the base member cavity provided therefor, regardless of the cross-sectional configuration of the mounting means as taken through these sides, are tapered, the interior base member walls which define the base member cavity also being correspondingly tapered.

It is a further feature of this invention that the cutting element carried by the mounting means will be located closer to the base member than is obtainable by anything in these arts previously known to the skilled worker therein.

Figure 23:
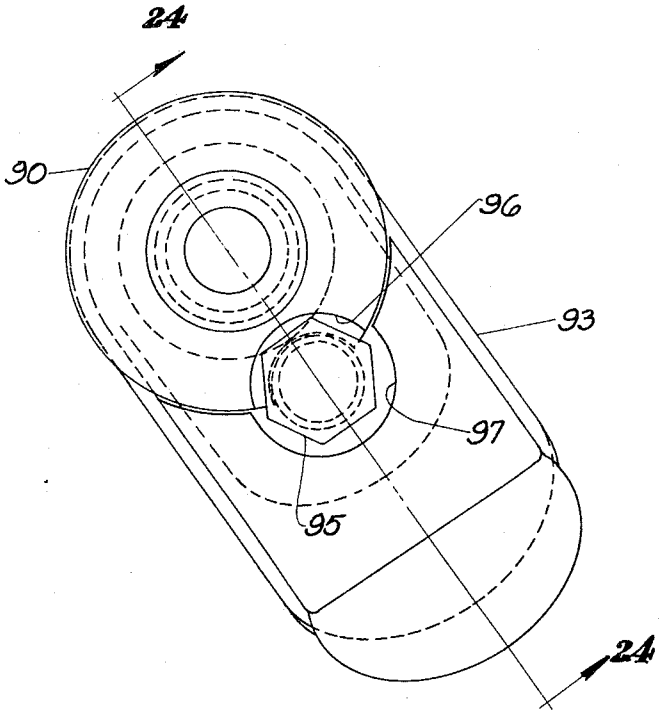
FIG. 23 is a front elevational view of another modification of the base member and mounting means arrangement of this invention wherein additional means are utilized to secure the mounting means within the base member and to prevent rotation of the mounting means within the base member.
Figure 24:
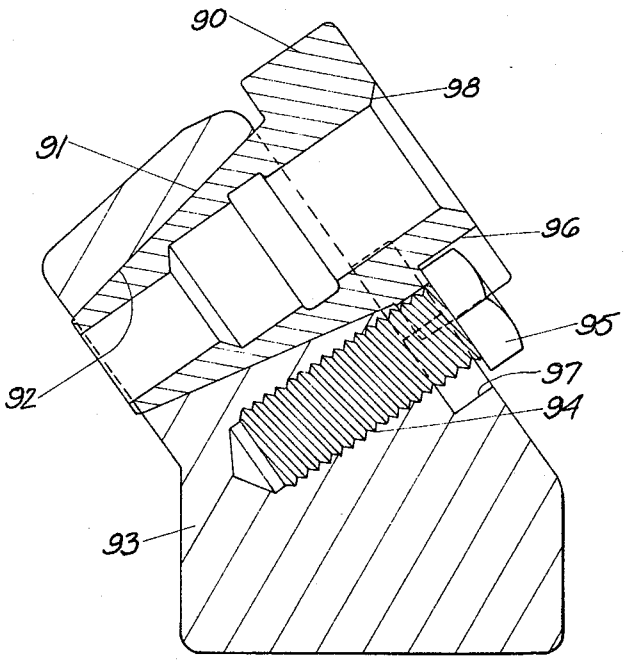
FIG. 24 is a section taken along the line 24—24 of FIG. 23.

The wedge arrangement of FIGS. 23 and 24 has some similarities to those, for example, of FIGS. 15 and 18. A mounting means 90 having a tapered portion 91 is located in a tapered cavity 92 provided in a base member 93. In order to insure that the mounting means 90 will be nonrotatably secured within the base member 93, a bolt 94 having a head 95 is threadeningly engaged with the body of the base member 93, the head 95 being engaged within a notch 96 provided in the mounting means 90. In this particular arrangement the base member 93 is also provided with a notch 97 capable of accommodating the head 95 if necessary. The bolt head 95 will bear against that part of the mounting means 90 disposed at the bottom of the notch 96 and will urge the mounting means tapered portion 91 into continuous engagement within the tapered cavity 92 while at the same time preventing rotation of the mounting means 90 within the base member 93.

The particular mounting means 90 illustrated in FIGS. 23 and 24 is intended to receive a plumb-bob bit. Such a bit will have a seated, abutting engagement within the beveled portion 98 of the mounting means 90. It is not a requirement of this invention, however, that any particular bit be utilized with any particular mounting means. Such a mounting means, for example, could be arranged to accommodate a bit such as shown at 36 in FIGS. 14 and 18. It would also be possible, however, to modify the mounting means so that it could accommodate the type of bit illustrated in FIG. 19 or in FIG. 3. Similarily it will be understood by those skilled in the art that the basic mounting means-base member arrangements of many of these figures may be modified so as to accommodate any desired type of bit while maintaining the substantially 360° wedge relationship between the base member tapered cavity and that part of the mounting means taper which is received therein. This will become even more apparent from the description to follow.

In FIG. 25 the mounting means 100 is illustrated as having a taper portion 101 which is received within the tapered cavity 102 of the base member 103. The side wall of the mounting means 100 is provided with a notch 104 which is engaged by the smooth end 105 of a threaded bolt 106. Engagement of the bolt portion 105 within the notch 104 will urge the mounting means into a full seated position within the base member while at the same time preventing rotation of such mounting means within such base member. Again, while the mounting means 100 has been illustrated as being of the type to receive a plumb-bob bit as evidenced by the beveled portion 107, it will be evident to those skilled in the art that the arrangement 104–106 could be applied to others of the mounting means base member combinations including, by way of example only, those illustrated in FIGS. 1, 3, 8A, 17 and 19.

Thus, in FIG. 26 the holding arrangement 104–106 is applied to a mounting means 110 and base member 111 wherein the mounting means is designed to accommodate a non-rotatable bit 112. The bit 112 is illustrated as having a tang 113 received within a notch 114 provided in the mounting means 110. A resilient retainer 115 engages within a groove 116 in the shank 117 of the bit 112 in order to hold that bit within the mounting means 110.

Figure 28B:
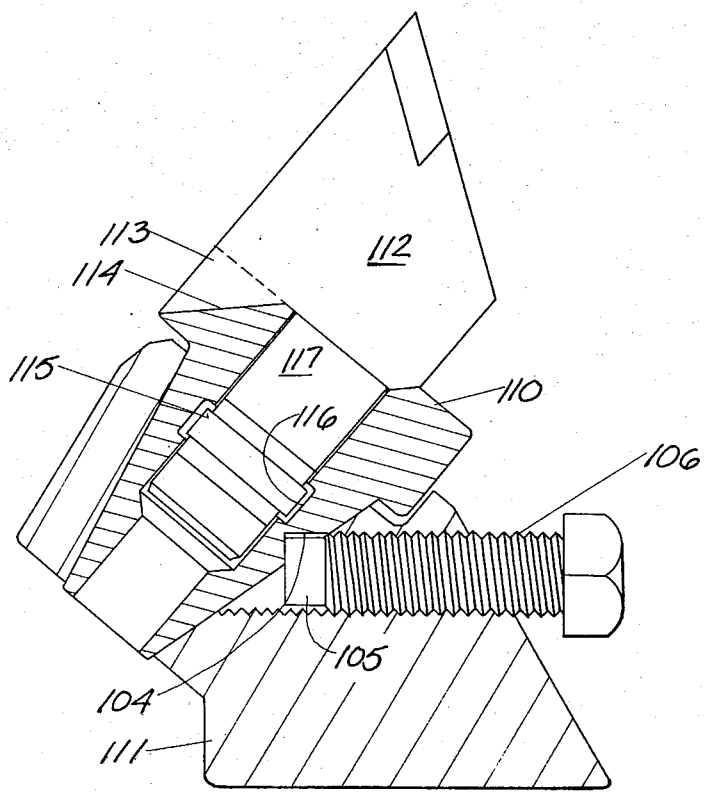
FIGS. 27 and 28 are sectioned side elevational views of the base member and mounting means arrangement of FIGS. 25 and 26 wherein the mounting means is shown as modified to receive still different styles of bit, noting also that this arrangement could be applied to the mounting means and bit illustrated in FIGS. 1 and 2.
Figure 28D:
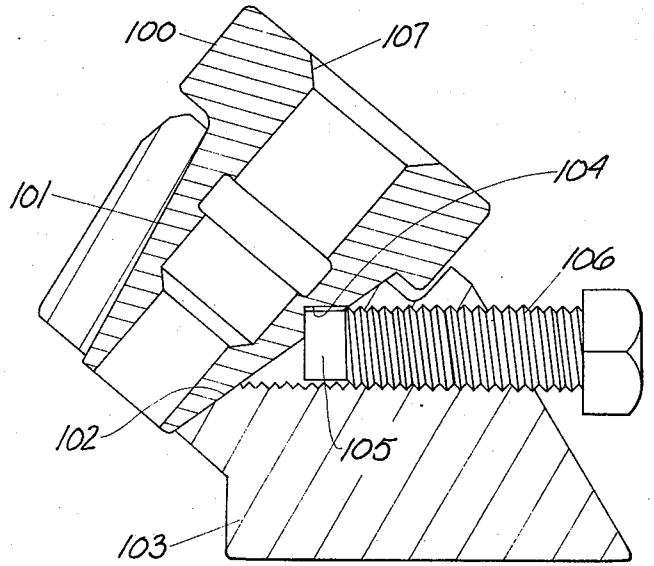
Figure 28:
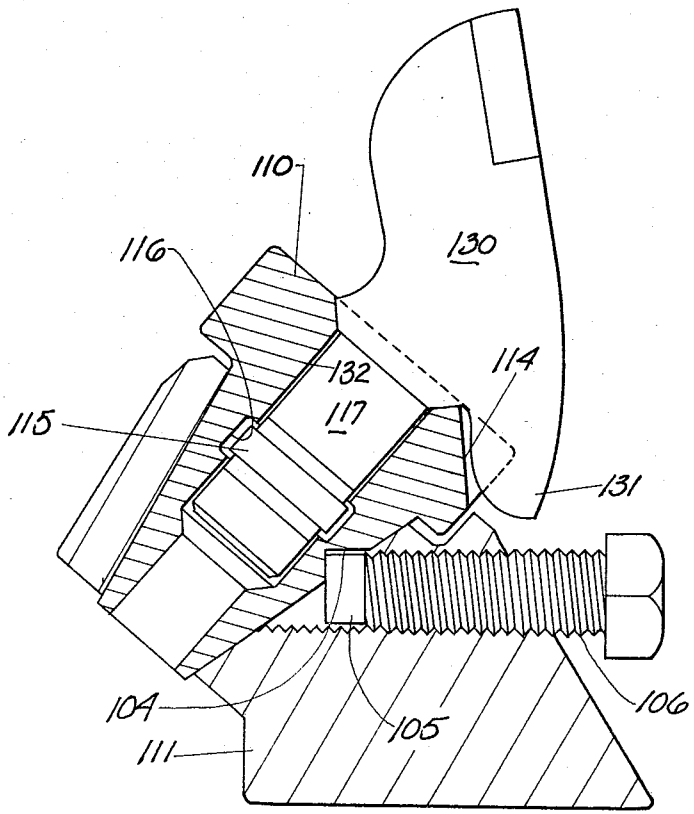
Figure 27:
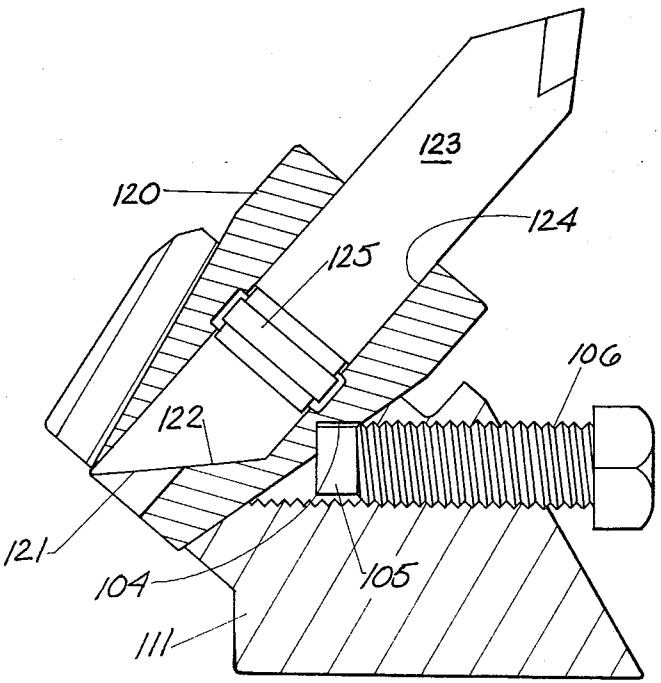

FIGS. 27 and 28 show other mounting means-base member wedged combinations employing the holding means 104–106, the principle difference being simply in the style of bit the respective mounting means is designed to accommodate. The mounting means 120 of FIG. 27 is provided with an internal abutment 121 to be engaged by the abutment surface 122 provided at an end of a nonrotatable bit 123. The abutting surfaces 121 and 122 insure that the bit 123 will not rotate within the shank receiving perforation 124 of the mounting means 120. A captive keeper 125 may be utilized to prevent the bit 123 from being dislodged from the mounting means 120. As with the other similar arrangements, the notch 104 in the mounting means 120 allows the setscrew 105–106 to hold the mounting means 120 in place within the base member 111 and prevents rotation of the mounting means 120 within that base member.

In the arrangement of FIG. 28 the mounting means is like that of FIG. 26 and like references have again been employed to designate like parts. Thus the mounting means 110 is again secured within the base member 111 by the 360° wedging action which is enhanced by engagement of the bolt or setscrew 105–106 within the notch 104. The bit 130 is provided with a tang 131 which engages within a slot 114 provided in the mounting means 110. By virtue of the slot 114 accommodating the mating tang 131 on the bit 130, rotation of such bit within the shank receiving perforation 132 of the mounting means 110 is prevented.

It should again be emphasized as should now be evident from the description given and from reference to all of the drawing figures that the 360° wedged arrangement for a mounting means within a base member is not dependent on the style of bit employed within the mounting means nor is it dependent on either rotatable or non-rotatable bits. It is true, however, that rotating bits reduce the tendency of the mounting means to rotate within the base member and, therefore, less stringent means may be utilized to keep the mounting means from rotating in the base member. By the same token it may be that when non-rotating bits are employed, more stringent means will be required to keep the mounting means from rotating within the base member. It should be apparent to those skilled in the art that the various means illustrated throughout this disclosure may be utilized to achieve these results.

Figure 29:
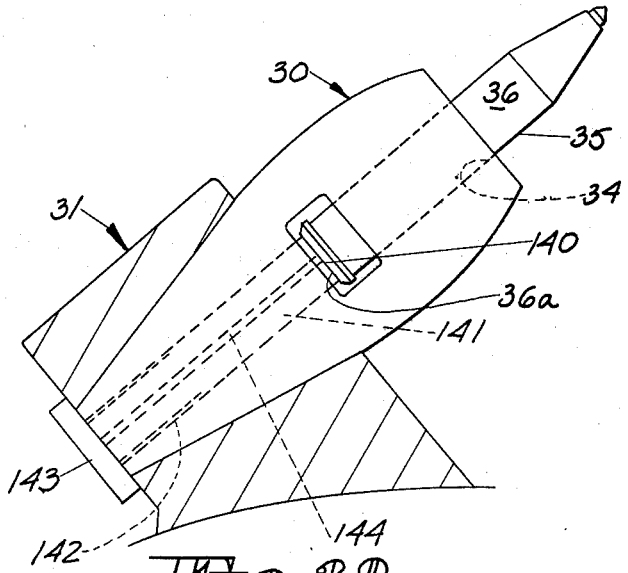
FIG. 29 is a fragmentary side elevational view, partly in cross section, illustrating the base member, mounting means, cutting element combination of this invention in the manner generally indicated in FIG. 14 but with still modified means for retaining the mounting means within the base member cavity and providing an anvil portion within the mounting means to be abutted by a rotatable bit of the type depicted.

The arrangement of FIG. 29 is a variation of the arrangements illustrated, for example, in FIGS. 1 and 14. The bit holder or mounting means 30 is provided with a shank receiving perforation 34 to accommodate the shank 35 of a rotatable bit 36 having a rear abutment surface 36*a*. In the arrangement of this FIG. 29, however, the anvil 42 of FIG. 1 is replaced by the end 140 of a bolt-like member 141 having a threaded portion 142 and a head 143. Thus the anvil 140 is a part of the means which retains the mounting means 30 in wedged 360° engagement within the base member 31. If desired the bolt-like member 141 could be provided with a bleed hole 144 that could also be utilized as a knock-out hole for the removal of broken bits.

Figure 31:
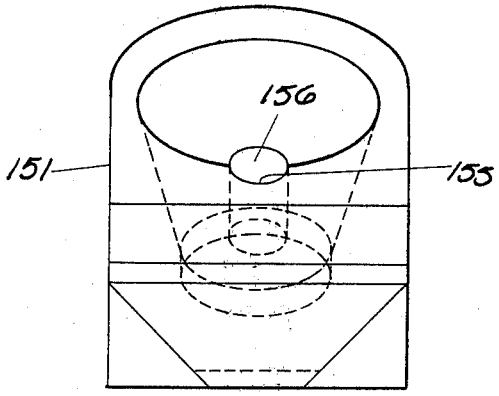
FIG. 31 is an elevation of the base member of FIG. 30 as seen from the right side of FIG. 30.
Figure 30:
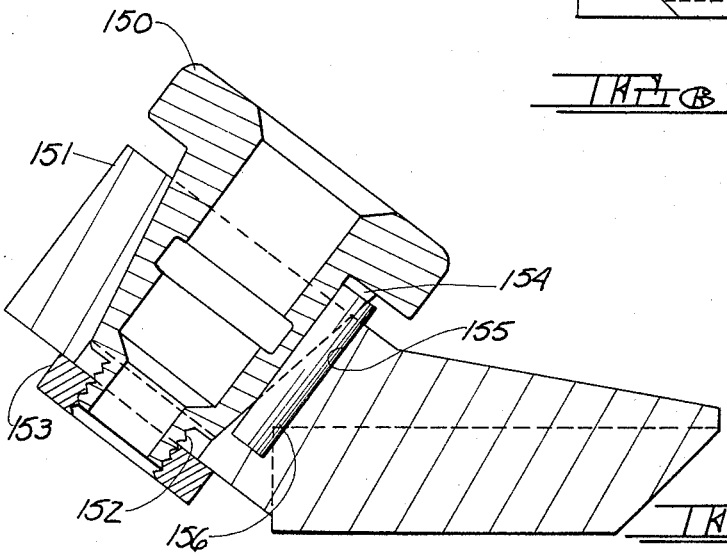
FIG. 30 is a fragmentary side elevational view, sectioned, depicting another manner in which the mounting means may be prevented from rotating within the base member.

FIGS. 30 and 31 illustrate another manner in which a bit holder 150 may be prevented from rotating within a base member 151. The threaded end 152 of the bit holder 150 is engaged by a nut 153 which will urge the bit holder 150 to a seated position within the base member 151 in the manner, for example, of the arrangement of FIG. 20. Although this arrangement will usually be sufficient to prevent rotation of the bit holder 150 within the base member 151, more positive means for that purpose are also utilized. In this particular arrangement such more positive means comprises a pair of mating grooves 154 in the bit holder 150 and 155 in the base member 151, a pin 156 being located in these mating grooves 154, 155 to prevent rotation.

Figure 32:
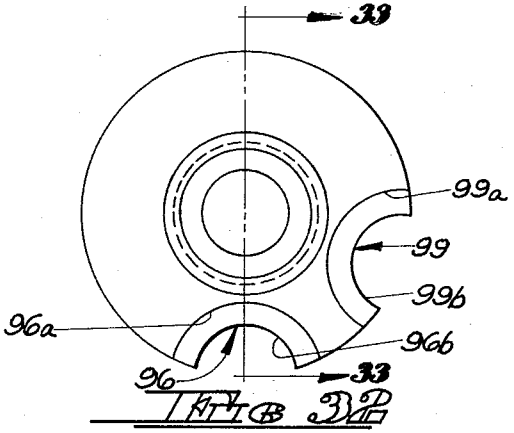
FIG. 32 is a top view of a mounting means generally like that depicted in FIGS. 23 and 24 but modified so as to provide two different locating positions for the mounting means within the base member.
Figure 33:
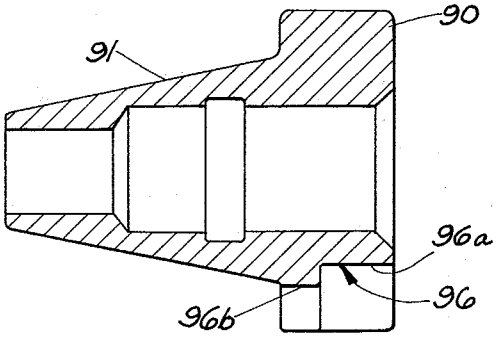
FIG. 33 is a sectioned side view taken along the line 33—33 of FIG. 32; this view is also representative of the mounting means depicted in FIG. 24.

The bit holder of FIGS. 32 and 33 is essentially like that of FIGS. 23 and 24 and, therefore, like numerals have been used to designate like parts. The essential difference between the bit holder of FIG. 32 and that of FIG. 24 is the provision of an extra notch 99; this extra notch 99 or second locating cutout permits the bit holder or mounting means 90 to be rotated if cored. These notches or locating cutouts 96 and 99 have enlarged portions 96*a* and 99*a* to accommodate the head of a retaining bolt or setscrew and a smaller portion 96*b* or 99*b* to accommodate the stem thereof, see also FIG. 24.

Coring, wear on the periphery of the bit holder or mounting means, may eventually occur during, for example, a mining operation. The arrangement of FIGS. 32 and 33 permits a longer life for the bit holder illustrated by permitting it to be rotated so as to present a different area to the abrasive working conditions encountered.

Figure 34:
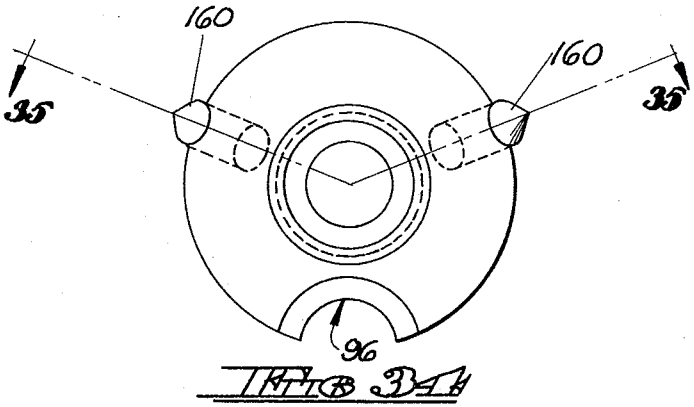
FIG. 34 is a top view of a mounting means such as that depicted in FIG. 24 but showing inclusion of wear resistant inserts or core breakers.
Figure 35:
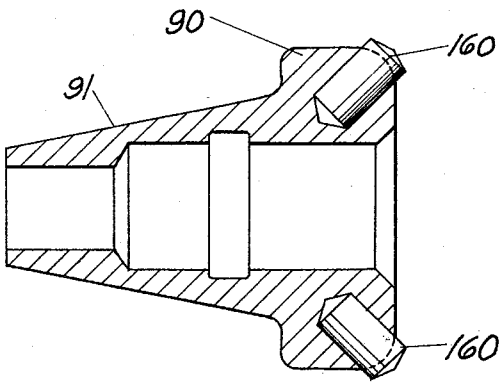
FIG. 35 is a view taken along the line 35—35 of FIG. 34.
Figures 3A, 3B:
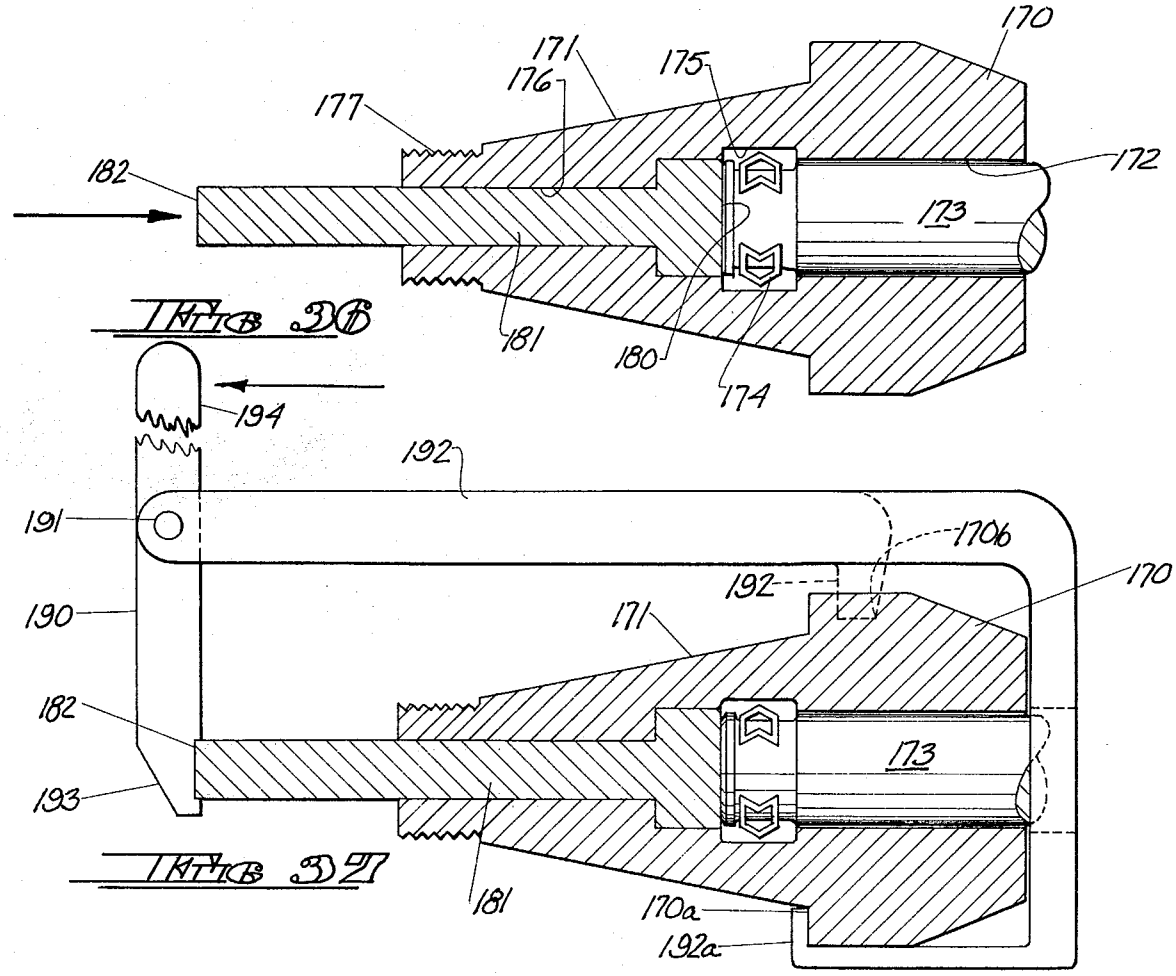
Figure 3B:
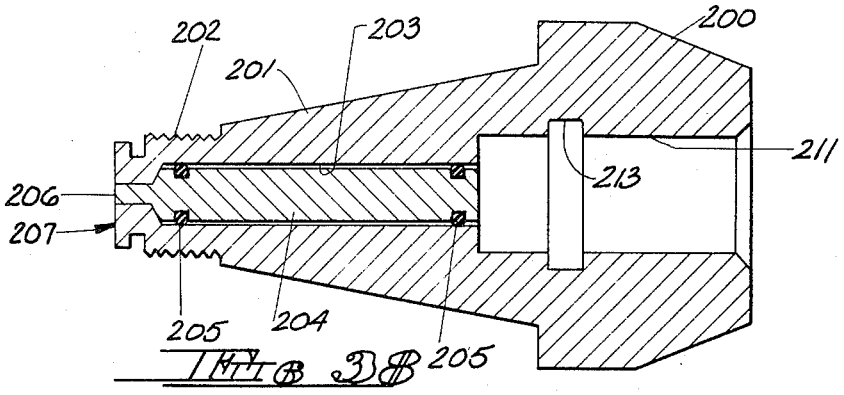
Figure 3D:
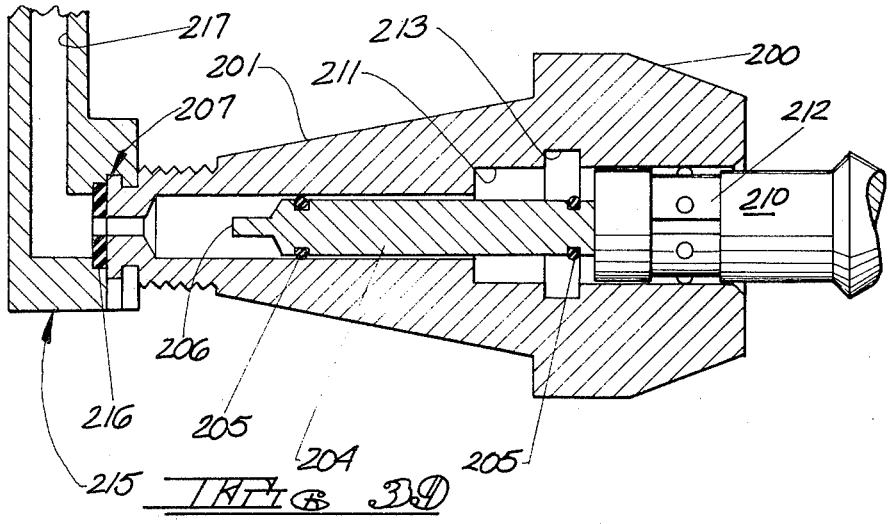

Another manner of prolonging the life of such a bit holder is illustrated in FIGS. 34 and 35 wherein hardened insert elements 160 have been located at strategic places about the periphery of the bit holder. Similar arrangements are broadly shown in U.S. Pat. No. 3,834,764—Krekeler.

It has been pointed out earlier that sometimes the various bits utilized in the wedged bit holder-base member combinations will break. It is sometimes difficult to, in the field, remove these bits readily from these wedged combinations, particularly those of the instant invention wherein the wedging action is obtained through substantially the full 360° engagement of the tapered bit holder portion within the corresponding tapered cavity of the base member. Sometimes it is possible to insert a drift or the like into the bit receiving cavity and thus force the broken bit therefrom; this could be accomplished, for example, in the arrangement of FIG. 29 wherein such a drift could be inserted through the knock-out hole or orifice 144. Other means are illustrated in the figures to be described. In this connection it should again be noted that while these means are illustrated as applied to certain kinds of bits, this is for purposes of illustration only, and it will be obvious to those skilled in the art that such means may be utilized to remove almost any kind of broken bit from the bit holder with which it is associated.

In FIG. 36 a representative bit holder 170 having a 360° tapered portion 171 is depicted. The bit holder is provided with a shank receiving perforation 172 to receive the shank 173 of what is illustrated as a rotatable bit. A captive keeper such as that shown in U.S. Pat. No. 3,767,266 is depicted at 174; this keeper is eventually received within a groove 175 provided at the end of the shank receiving perforation 172. The end of the bit shank 173 abuts an anvil 180. In this particular arrangement the anvil 180 is located on a movable plunger 181 which is received in a suitable perforation 176 in the bit holder 170; the plunger 181 has an end 182 which normally extends well beyond the threaded end 177 of the bit holder 170. If the bit or bit shank 173 should break, it may be removed by simply applying blows to the end 182 of the plunger 181. (If the bit were simply worn, not broken, it could be removed, for example, with a tool such as described in U.S. Pat. No. 3,769,683.)

Many of the features illustrated in FIG. 37 are like those depicted in FIG. 36 and, therefore, like numerals have been used to designate like parts. It is recognized that in some instances it may be impractical to strike the end 182 of the plunger 181 with a hammer or the like. The arrangement of FIG. 37, therefore, illustrates a removable tool as applied to a bit holder generally like that illustrated in FIG. 36. The removable bit removing tool of FIG. 37 comprises a lever 190 pivoted at 191 to an arm 192 which may engage any convenient purchase point on the bit holder. An end 193 of the lever 190 is adapted to engage the plunger end 182. The other end 194 of the lever is that against which pressure will be applied, as indicated by the arrow in that figure, in order to move the plunger 181 so as to eject the broken bit represented by the bit shank 173. The full line extension **192*a* of FIG. 170 engages beneath a shoulder 170*a* to establish a suitable purchase point for the member 192. An alternative arrangement is shown in dotted lines at 192*b* wherein a notch 170*b* is provided in the bit holder 170 to establish the required purchase point for the member 192**. Any convenient purchase point may be utilized; it could even be located on a remote component.

A somewhat different knock-out means is depicted in FIGS. 38 and 39. Again, while the bit fragment illustrated is that of a plumb-bob bit, the invention may be applied to bit holder-base member wedged combinations in which a variety of bits are used. The bit holder or mounting means 200 of these figures is provided with a 360° tapered portion 201 to be received within a corresponding cavity of a base member. The bit holder 200 may be secured within such base member by any number of means; in FIGS. 38 and 39 such means are comprised of a nut which will engage the threaded end 202 of the bit holder 200. This bit holder is provided with an axial bore 203 to slidably receive a piston 204 therein. The piston is properly sealed as indicated at 205. The piston 204 terminates in a button 206 received within an adapter section 207 provided at the end of the bit holder 200. In its at-rest position the plunger 204 will be located as shown in FIG. 38. A bit having a shank portion 210 will be located in the bit holder 200 and shank receiving portion 211 thereof. A captive keeper 212 located on the bit shank 210 will be received within the groove 213. This captive keeper may be of any resilient style such as to permit it to be collapsed while passing through the shank perforation 211 and being such as to thereafter expand into the groove 213 in order to retain the bit shank within the bit holder.

If the bit should break and it is required to remove the remaining bit fragment from the bit holder 200, a mating fitting 215 is applied to the member 207 provided at the end of the bit holder 200 and a pressure fluid is introduced so as to act against the piston button 206 and piston 204 to force the piston against the bit fragment so as to overcome the captive keeper 212 and eject the bit fragment from the bit holder, or at least project it far enough therefrom that it may be engaged by other means and removed from the bit holder. Additional sealing means 216 may be provided in the mating fitting section 215. A high pressure, expandable fluid may then be applied via the channnel 217. In some instances it may be desirable to recover the fluid and this might be achieved by applying a suction arrangement (not shown) to the fitting 215.

Figure 40:
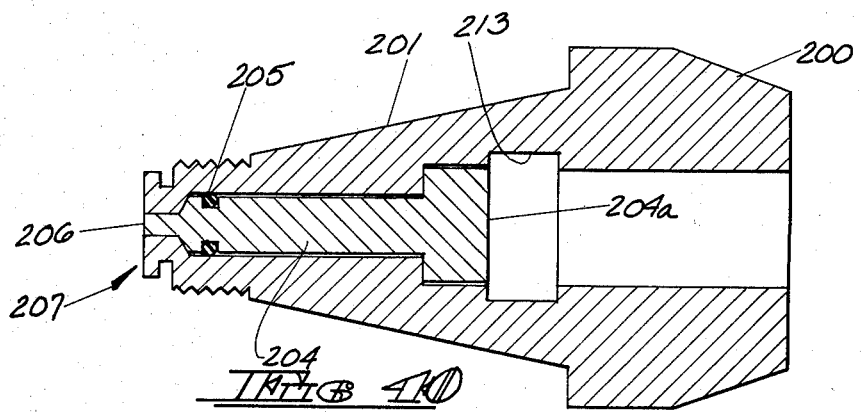
FIG. 40 is a sectioned side view similar to those of FIGS. 38 and 39 illustrating a mounting means adapted to receive one type of rotatable bit and including a modified bit expelling plunger which incorporates an anvil against which the rotating bit normally abuts.

The arrangement of FIG. 40 is much like that illustrated in FIG. 39 and like reference numerals have been employed to designate like parts. In this particular arrangement it is contemplated that a cylindrical, rotatable bit of the type shown in, for example, FIG. 1, will be employed and the piston 204 is provided with an anvil **204*a* against which the end of the bit will abut, the appropriate captive keeper on the bit shank being received in the groove 213. This plunger 204, 204*a*** could, however, expel other kinds of bits so long as it may be so actuated as to pass into the perforation in which the bit shank is located.

Figure 41:
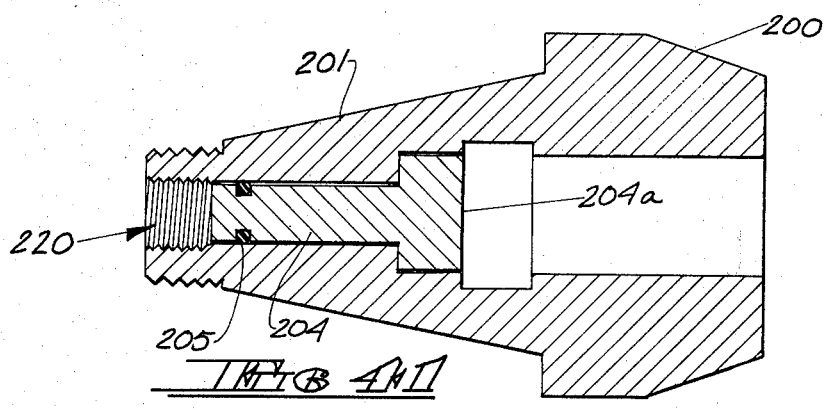
FIG. 41 is a sectioned side view generally similar to that of FIG. 40 but illustrating a threaded fitting for applying fluid pressure to actuate the bit expelling plunger.

The arrangement of FIG. 41 is much like that of FIGS. 39 and 40 differing in that the special fitting 207 has been replaced by a threaded fitting 220 for the application of fluid pressure. The fitting or member 220 could also be adapted to receive a screw means to engage and eject the broken bit.

The fittings generally indicated at 207, 215 and 220 in, for example, FIGS. 38,39 and 41, may be of various types. They could, for example, be like those used with the grease fittings and grease guns which are known in the art. In some instances it may be necessary to use non-flamable fluids such as silicone jelly or water. In any event it will be understood by those skilled in the art that appropriate power sources, connectors and fluids are available.

The various means illustrated provide good ways in which remaining broken bit shank fragments may be quickly removed in the field, not only from the 360° wedged combination of mounting means and base member, but also from other bit holders, without having to tear the machinery completely apart. Such means have been illustrated as comprising an extension to be struck a blow, a lever arrangement and other means for applying pressure. The type of bit utilized in the bit holder does not constitute a limitation on any aspect of this invention. Thus it will be understood that the basic inventive concept resides in the manner of providing a 360° wedged combination of mounting means (bit holder) and base member, which arrangement may be supplemented and amplified by various means for further securing the mounting means within the base member and for preventing rotation of the mounting means in the base member, the arrangement also contemplating provision of means for quickly removing broken bits from the wedged combination. Various mounting means may be used in the wedged combination of mounting means and base member, and these mounting means may be arranged to accommodate a variety of bits. Representative examples of the kinds of bits that may be utilized in the wedged combination are depicted, by way of example only, in FIGS. 1, 3, 17, 26, 27, 28 and 39. That facet of the invention which contemplates quick removal of such bits from the wedged combination resides in various means which may be applied to any of the wedged combinations and the particular bits therein employed.

Modifications may be made in this invention without departing from the scope and spirit thereof. While the invention has been shown and described in terms of certain particular structures and arrangements, the invention is not to be limited to those particular structures and arrangements except insofar as they are specifically set forth in the subjoined claims.

What is claimed is:

1. A mounting means-base member combination for use in mining, road planing or earth moving equipment, the combination comprising a mounting means having a shank receiving perforation to receive the shank of a bit having a cutting end at one end thereof, said mounting means being provided with a first body portion to be engaged with the base member; and a base member provided with socket means to receive said first body portion of said mounting means, the improvement which is characterized by: said first body portion being tapered and said socket means comprising a cavity which is correspondingly tapered so as to just nicely receive said first body portion therein with a wedge action whereby to prevent relative movement between said first body portion and said base member, said tapered cavity extending through a substantial portion of said base member, said base member completely surrounding that part of said tapered first body portion which is received in said tapered cavity, said mounting means-base member combination being fixed against rotation about its axis; and retaining means to retain said tapered first body portion in its seated position within said tapered cavity and to urge said first body portion into full seated position within said base member; and said mounting means having a second body portion extending beyond said tapered cavity, said second body portion and said base member being free of abutting surfaces so as to provide clearance for said wedge action, said shank receiving perforation being at least in said second body portion and extending within at least a substantial length thereof.

2. The combination of claim 1 in which said tapered first body portion is circular in cross section.

3. The combination of claim 1 in which said tapered first body portion is other than circular in cross section.

4. The combination of claim 1 in which an end of said shank receiving perforation extends within said tapered cavity.

5. The combination of claim 1 including a bit having a shank in said perforation, and means to retain said shank in said perforation.

6. The combination of claim 5 in which said shank is rotatable within said perforation.

7. The combination of claim 5 in which said shank is non-rotatable within said combination.

8. The combination of claim 5 in which said shank, while in said perforation, extends within said tapered cavity.

9. The combination of claim 5 in which said shank, while in said perforation, is in close proximity to said tapered cavity.

10. The combination of claim 1 including additional means to aid in preventing relative movement between (a) that part of said tapered body portion which is seated within said correspondingly tapered cavity and (b) said base member.

11. The combination of claim 1 in which said shank receiving perforation is so disposed within said mounting means that when said tapered body portion is seated within said correspondingly tapered cavity, said shank receiving perforation is in close proximity to said tapered cavity.

12. A combination of a mounting means and a base member, said combination being for use in mining, road planing or earth moving equipment in which said combination is itself fixed against rotation about its axis, said mounting means having a shank receiving perforation to receive the shank of a bit having a cutting end at one end thereof, the improvement which comprises: a first tapered portion on said mounting means, said base member having a correspondingly tapered cavity, said tapered cavity extending through a substantial portion of said base member, said base member completely surrounding that part of said first tapered portion which is seated in said tapered cavity, and said first tapered portion being seated within said tapered cavity with a wedge fit which is 360° in scope whereby to impede relative movement between said mounting means and said base member; and retaining means to both retain said first tapered portion within said tapered cavity and to urge said first tapered portion into full seated position within said tapered cavity; said mounting means having a second portion adjacent said first tapered portion and extending beyond said tapered cavity, said second portion and said base member being free of abutting surfaces so as to provide clearance for said wedge fit, said shank receiving perforation being at least in said second portion and extending within at least a substantial length thereof.

13. The combination of claim 12 in which said mounting means has an extension extending through the bottom of said tapered cavity and beyond said base member, and said retaining means comprises a spring-clip which engages said extension and said base member.

14. The combination of claim 12 in which said mounting means has an extension extending through the bottom of said tapered cavity and beyond said base member, and said retaining means comprises a pin extending through said extension.

15. The combination of claim 14 in which said base member has a cam surface and said pin has a camlock portion in engagement with said cam surface.

16. The combination of claim 14 including a washer on said extension against said base member and said washer has a cam surface, and said pin has a cam-lock portion in engagement with said cam surface.

17. The combination of claim 12 in which said mounting means and said base member are provided with holes which are slightly out of alignment when said tapered portion is seated in said tapered cavity, and said retaining means comprises a resilient member having an interference fit in said holes.

18. The combination of claim 12 in which said retaining means comprises a threaded member screwed into said mounting means, said threaded member having a head engaging said base member.

19. The combination of claim 12 in which said retaining means comprises a bolt passing through a clearance hole in said base member and threadedly engaged in said mounting means, the bolt having a head which engages said base member.

20. The combination of claim 12 in which said retaining means comprises a bolt having a head engaged with said mounting means and a threaded portion extending through said base member, and a nut on said threaded portion in engagement with said base member.

21. The combination of claim 12 in which said retaining means comprises a headed screw-member engaging said mounting means and screwed into said base member.

22. The combination of claim 12 in which said tapered portion is seated within said tapered cavity so that said shank receiving perforation is disposed in close proximity to said tapered cavity.

23. The combination of claim 12 in which said retaining means comprises a setscrew engaging both the said base member and the said mounting means.

24. The combination of claim 23 in which said setscrew is threaded into said base member, said setscrew having an enlarged head which is located in a notch provided in said mounting means.

25. The combination of claim 24 in which there is at least one additional notch in said mounting means capable of receiving said enlarged head.

26. The combination of claim 23 in which said tapered portion is provided with a notch, said setscrew being threaded into said base member and having an end portion engaged within said notch.

27. The combination of claim 12 in which said retaining means comprises a threaded member engaged within said tapered portion and having one end terminating in a head which engages said base member and an opposite end which serves as an anvil within said shank receiving perforation to be engaged by a cutting element shank.

28. The combination of claim 27 including a bleed and knock-out hole extending axially through said threaded member.

29. The combination of claim 12 in which a bleed and knock-out hole is provided axially through said tapered portion into said shank receiving perforation.

30. The combination of claim 12 in which said retaining means comprises mating cavities provided in said tapered portion and in said base member, and a pin engaged within said mating cavities.

31. The combination of claim 12 in which said mounting means is provided with hard wear inserts to prevent coring.

32. The combination of claim 12 including means to expel the shank of a bit from the shank receiving perforation, said last mentioned means comprising a bore in said tapered portion and a plunger-like element in said bore extending towards said shank receiving perforation and adapted to be moved into said perforation to engage and move said shank.

33. The combination of claim 32 in which said plunger-like element extends beyond said wedge fitted mounting means and base member a distance sufficient to enable a force to be applied thereto for moving said plunger-like element against said shank to thereby move same.

34. The combination of claim 33 including a lever arrangement for applying said force to said plunger-like element.

35. The combination of claim 32 in which said plunger-like element comprises a piston, and said combination including a fitting for coupling said combination to a source of fluid pressure whereby to actuate said piston to expel a said shank.

36. The combination of claim 35 in which one end of said piston serves as a rear abutment anvil surface for the shank of a said bit.

37. A base member for use in a mounting means-base member combination wherein the mounting means has a wedge fit within said base member, said base member comprising: an element having a tapered cavity therein, said tapered cavity extending through a substantial portion thereof, said tapered cavity being adapted to receive a portion at least of a correspondingly tapered mounting means, said element being arranged to surround that portion of said tapered mounting means which has said wedge fit therein, said element having means associated therewith to aid in preventing rotation of said mounting means portion within said cavity and to urge said mounting means portion into full seated position within said cavity.

38. The base member of claim 37 in which a cross section through said walls which define the tapered cavity is circular.

39. The base member of claim 37 in which a cross section through said tapered walls which define the tapered cavity is other than circular.

40. The base member of claim 37, in which said means to aid in preventing rotation comprises a setscrew so located in said base member as to enable a head thereon to engage within a notch provided in said mounting means when seated within said base member.

41. The base member of claim 37 in which said means to aid in preventing rotation comprises a setscrew so located in said base member as to enable an end thereof to engage within a notch provided in said mounting means tapered portion when said tapered portion is seated within said base member.

42. The base member of claim 37 in which said means to aid in preventing rotation comprises a pin located in a perforation so arranged as to mate with a corresponding perforation provided in a said mounting means when seated in said tapered cavity.

43. A mounting means for use in a mounting means-base member combination wherein the mounting means has a wedge fit within said base member, said mounting means comprising: a first portion provided with a shank receiving perforation adapted to receive the shank of a bit having a cutting end at one end thereof, said shank receiving perforation extending within at least a substantial length of said first portion; a second portion adapted to be received within a tapered cavity provided in said base member, said tapered cavity extending through a substantial portion of said base member, said second portion being tapered so as to have a wedge fit within said tapered cavity, a portion at least of said second portion being adapted to be surrounded by said base member when so seated in said cavity; and means on said mounting means for engagement by a retaining means which urges said mounting means into full seated position within said cavity, said first portion extending beyond said tapered cavity to provide clearance for said wedge fit.

44. The mounting means of claim 43 in which a cross section through said second portion is circular.

45. The mounting means of claim 43 in which a cross section through said second portion is other than circular.

46. The mounting means of claim 43 including additional means associated with said mounting means to aid in preventing relative movement between said second portion and said tapered cavity.

47. The mounting means of claim 46 in which said additional means comprises a notch therein to receive the head of a setscrew located in the base member when said mounting means is seated in the tapered base member cavity.

48. The mounting means of claim 47 including a second of said notches.

49. The mounting means of claim 46 in which said additional means comprises a notch located in said second portion so as to receive the end of a setscrew located in a base member when said second portion is seated within the tapered base member cavity.

50. The mounting means of claim 46 in which said additional means comprises a member engaged within said second portion, said member being provided with a head to engage a base member when said second portion is seated within the tapered base member cavity.

51. The mounting means of claim 50 in which an end of said member comprises an anvil located within said shank receiving perforation.

52. The mounting means of claim 51 in which said member is provided with a bleed and knock-out hole extending therethrough.

53. The mounting means of claim 46 in which said additional means includes a perforation in said second portion so located as to receive a member located within a mating corresponding perforation located in a base member when said second portion is seated within the tapered base member cavity.

54. The mounting means of claim 43 including hard wear inserts located therein so as to prevent coring.

55. A knock-out arrangement for ejecting a bit from a wedged-together bit holder-base member combination including means to retain said bit holder within said base member and to urge said bit holder into full seated position within said base member to establish a wedge fit, said bit holder having a shank receiving perforation therein extending within at least a substantial length thereof and the bit having a shank received in the perforation and a cutting end extending outside of said perforation, said knock-out arrangement comprising: a bore extending through said combination to said shank receiving perforation, and a plunger-like element in said bore extending towards said shank receiving perforation and adapted to be moved into said perforation to engage and eject said shank.

56. The knock-out arrangement of claim 55 including an extension on said plunger-like element remote from said perforation and normally protruding from said wedged-together bit holder-base member combination.

57. The knock-out arrangement of claim 56 including lever means engaging said extension.

58. The knock-out arrangement of claim 55 in which said eject means includes a fitting so located on said wedged-together bit holder-base member combination as to permit said combination to be coupled to a source of fluid power for actuating said plunger-like element within said bore.

59. The knock-out arrangement of claim 55 in which one end of said plunger-like element normally extends within said perforation so as to serve as an anvil for the shank of a bit.

60. The knock-out arrangement of claim 55 including screw means operable within said bore to engage said plunger-like element.

61. A knock-out arrangement for ejecting a bit from a bit holder, said bit holder having a shank receiving perforation therein extending within at least a substantial length thereof and the bit having a shank received in the perforation and a cutting end extending outside of said perforation, said knock-out arrangement comprising: a bore extending in said bit holder to said shank receiving perforation, a plunger-like element located wholly within said bore and extending towards said shank receiving perforation and adapted to be moved into said perforation to engage and eject said shank, and eject means for actuating said plunger-like element, said eject means being connected to said bit holder.

62. The knock-out arrangement of claim 61 in which said eject means includes a fitting so located on said bit holder as to permit said bit holder to be coupled to a source of fluid power for actuating said plunger-like element within said bore.

63. The knock-out arrangement of claim 61 in which one end of said plunger-like element normally extends within said perforation so as to serve as an anvil for the shank of a bit.

64. The knock-out arrangement of claim 61 in which said eject means comprises screw means operable within said bore to engage said plunger-like element.

65. A combination of a mounting means and a base member, said combination being for use in mining, road planing or earth moving equipment in which said combination is itself fixed against rotation about its axis, said mounting means having a shank receiving perforation to receive the shank of a bit having a cutting end at one end thereof, said perforation extending within at least a substantial length of said mounting means, the improvement which comprises: a tapered portion on said mounting means, said base member having a correspondingly tapered cavity extending through a substantial portion thereof, said base member completely surrounding that part of said tapered portion which is seated in said tapered cavity, and said tapered portion being seated within said tapered cavity with a wedge fit which is 360° in scope whereby to impede relative movement between said mounting means and said base member; and a retaining means to hold said tapered portion in its seated position within said tapered cavity; said mounting means having an extension extending through the bottom of said tapered cavity and beyond said base member and said retaining means comprising a threaded portion on said extension and a nut on said threaded portion in engagement with said base member.

66. A knock-out arrangement for ejecting a bit from a bit holder, said bit holder having a shank receiving perforation therein extending within at least a substantial length thereof and the bit having a shank received in the perforation and a cutting end extending outside of said perforation, said knock-out arrangement comprising: a bore extending in said bit holder to said shank receiving perforation, a plunger-like element in said bore extending towards said shank receiving perforation and adapted to be moved into said perforation to engage and eject said shank, and eject means for actuating said plunger-like element, said eject means comprising an extension on said plunger-like element remote from said perforation and normally protruding from said bit holder through said base member so as to be accessible from outside of said base member.

67. The knock-out arrangement of claim 66 including lever means engaging said extension.

68. The knock-out arrangement of claim 66 in which one end of said plunger-like element normally extends within said perforation so as to serve as an anvil for the shank of a bit.

69. The knock-out arrangement of claim 66 in which said eject means comprises screw means operable within said bore to engage said plunger-like element.

* * * * *

UNITED STATES PATENT AND TRADEMARK OFFICE

CERTIFICATE OF CORRECTION

PATENT NO. : 4,337,980

DATED : July 6, 1982

INVENTOR(S) : Claude B. Krekeler

It is certified that error appears in the above-identified patent and that said Letters Patent is hereby corrected as shown below:

In line 44 of column 3 the word "is" should be "in".

In line 16 of column 5 the word "fore" should be "for".

In line 5 of column 11 the "A" should be "a".

In line 51 of column 13 the word "welding" should be "wedging".

Signed and Sealed this

*Thirtieth* Day of *November 1982*

[SEAL]

*Attest:*

GERALD J. MOSSINGHOFF

*Attesting Officer*

*Commissioner of Patents and Trademarks*